US010967414B2

(12) United States Patent
Saika et al.

(10) Patent No.: US 10,967,414 B2
(45) Date of Patent: Apr. 6, 2021

(54) FORMING DEVICE

(71) Applicant: SUMITOMO HEAVY INDUSTRIES, LTD., Tokyo (JP)

(72) Inventors: Masayuki Saika, Ehime (JP); Masayuki Ishizuka, Ehime (JP); Norieda Ueno, Tokyo (JP); Shuji Miyazaki, Kanagawa (JP); Koji Moritani, Kanagawa (JP); Taizo Yamamoto, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 279 days.

(21) Appl. No.: 15/887,643

(22) Filed: Feb. 2, 2018

(65) Prior Publication Data

US 2018/0221933 A1 Aug. 9, 2018

Related U.S. Application Data

(63) Continuation of application No. PCT/JP2016/075008, filed on Aug. 26, 2016.

(30) Foreign Application Priority Data

Aug. 28, 2015 (JP) ..... JP2015-169494

(51) Int. Cl.
*B21D 26/047* (2011.01)
*B21D 26/033* (2011.01)

(52) U.S. Cl.
CPC ..... *B21D 26/047* (2013.01); *B21D 26/033* (2013.01)

(58) Field of Classification Search
CPC ..... B21D 26/047; B21D 26/033
USPC ..... 72/61
See application file for complete search history.

(56) References Cited

U.S. PATENT DOCUMENTS 4,437,326 A * 3/1984 Carlson ..... B21D 26/043 72/364
5,129,252 A * 7/1992 Hahn ..... B21D 22/28 72/349
5,960,658 A * 10/1999 Hudson ..... B21D 26/033 72/61

(Continued)

FOREIGN PATENT DOCUMENTS

JP H08-071771 A 3/1996
JP 2002-018531 A 1/2002

(Continued)

OTHER PUBLICATIONS

International Search Report issued in Application No. PCT/JP/2016/075008, dated Oct. 4, 2016.

*Primary Examiner* — Adam J Eiseman
*Assistant Examiner* — Mohammed S. Alawadi
(74) *Attorney, Agent, or Firm* — Michael Best & Friedrich LLP

(57) ABSTRACT

A forming device that expands a metal pipe material to form a metal pipe includes a die that has an upper die and a lower die, at least one of which is movable, and that form the metal pipe, an electrode that energizes the metal pipe material to heat the metal pipe material, a gas supply part that supplies a gas into the heated metal pipe material to expand the metal pipe material, and a die movement suppressing part that suppresses the movement of the die by an electromagnetic force at least when the energization to the metal pipe material is performed by the electrode.

15 Claims, 15 Drawing Sheets

(56) References Cited

U.S. PATENT DOCUMENTS

| | | | | |
|---|---|---|---|---|
| 5,992,197 | A * | 11/1999 | Freeman | B21D 26/033 29/421.1 |
| 6,322,645 | B1 * | 11/2001 | Dykstra | A61F 13/15203 148/520 |
| 7,024,897 | B2 * | 4/2006 | Pfaffmann | B21D 26/033 148/520 |
| 7,305,860 | B2 * | 12/2007 | Yang | B21D 26/033 29/421.1 |
| 8,909,433 | B2 | 12/2014 | Jung et al. | |
| 2007/0101786 | A1 * | 5/2007 | Yang | B21D 26/033 72/61 |
| 2015/0013894 | A1 * | 1/2015 | Matsen | B23K 20/12 156/272.4 |
| 2016/0279693 | A1 | 9/2016 | Ueno et al. | |
| 2018/0221933 | A1 * | 8/2018 | Saika | B21D 26/033 |

FOREIGN PATENT DOCUMENTS

| | | | |
|---|---|---|---|
| JP | 2012-000654 | A | 1/2012 |
| JP | 2013-107621 | A | 6/2013 |
| JP | 2015-112608 | A | 6/2015 |

* cited by examiner

FORMING DEVICE

RELATED APPLICATIONS

Priority is claimed to Japanese Patent Application No. 2015-169494, filed Aug. 28, 2015, and International Patent Application No. PCT/JP2016/075008, the entire content of each of which is incorporated herein by reference.

BACKGROUND

Technical Field

Certain embodiments of the present invention relate to a forming device.

Description of Related Art

A forming device that forms a metal pipe by blow forming after closing a die has been known. For example, a forming device disclosed in the related art is provided with a die and a gas supply part that supplies a gas into a metal pipe material. In this forming device, a metal pipe material is disposed in the die, and in a state in which the die is closed, the metal pipe material is expanded by a gas supplied from the gas supply part to form the metal pipe material into a shape corresponding to a shape of the die. In this forming device, before the expansion of the metal pipe material, the metal pipe material is held by electrodes and heated by energization of the electrodes.

SUMMARY

According to an embodiment of the present invention, there is provided a forming device that expands a metal pipe material to form a metal pipe includes a die that has an upper die and a lower die, at least one of which is movable, and that form the metal pipe, an electrode that energizes the metal pipe material to heat the metal pipe material, a gas supply part that supplies a gas into the heated metal pipe material to expand the metal pipe material, and a die movement suppressing part that suppresses the movement of the die by an electromagnetic force at least when the energization to the metal pipe material is performed by the electrode.

BRIEF DESCRIPTION OF THE DRAWINGS

FIG. 3A is a view showing a state in which a metal pipe material is held by the electrodes. FIG. 3B is a view showing a state in which a sealing member is brought into contact with the electrodes. FIG. 3C is a front view of the electrodes.

FIG. 4(*a*) is a diagram showing a state in which a metal pipe material is set in a die. FIG. 4(*b*) is a diagram showing a state in which the metal pipe material is held by the electrodes.

DETAILED DESCRIPTION

Figure 1:
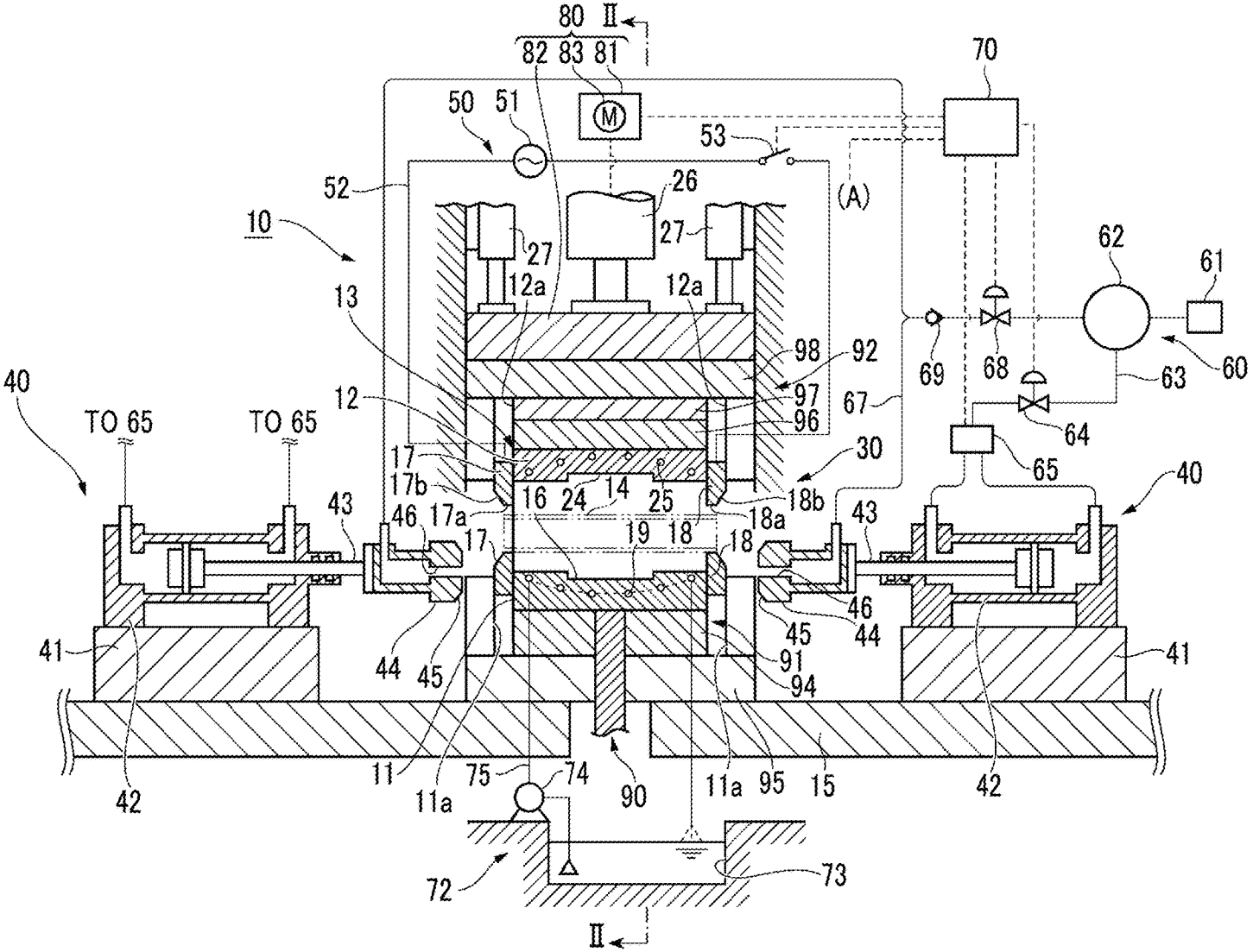
FIG. 1 is a schematic diagram showing a configuration of a forming device according to a first embodiment of the invention.

Here, in the forming device, the die or a member around the die may be magnetized in a case where the metal pipe material is heated by energization of the electrodes. In such a case, while the metal pipe material is heated by energization, an electromagnetic force may act on the magnetized die such that the die is moved in a sliding direction that is a moving direction of the die. In a case where the die is moved by the electromagnetic force acting thereon and brought into contact with the metal pipe material during the heating by energization, electrical leakage may be caused via the die and the device may be damaged.

It is desirable to provide a forming device in which stability can be improved.

According to the forming device, the die movement suppressing part suppresses the movement of the die by an electromagnetic force at least when the energization to the metal pipe material is performed by the electrode. That is, even in a case where a mechanism that heats the metal pipe material by energization of the electrode is provided, it is possible to suppress the movement of the die toward the metal pipe material by an electromagnetic force. Accordingly, stability can be improved.

In the forming device, the die movement suppressing part may be provided with a fixing part that mechanically fixes the lower die at least when the energization to the metal pipe material is performed by the electrode. In a case where the fixing part mechanically fixes the lower die that is easily moved by an electromagnetic force, the movement of the lower die can be securely suppressed.

In the forming device, the fixing part may be provided with a pin that is inserted into a side surface of the lower die at least when the energization to the metal pipe material is performed by the electrode. By employing a configuration in which the pin is inserted from the side surface side of the lower die, the fixing part can be simply configured, and interference with another mechanism can be avoided.

In the forming device, the die movement suppressing part may be provided with a die magnetization suppressing part that suppresses the movement of the die by an electromagnetic force by suppressing the magnetization of the die. By suppressing the magnetization of the die by the die magnetization suppressing part, the electromagnetic force acting on the die can be reduced when the energization to the metal pipe material is performed by the electrode. Accordingly, the movement of the die by an electromagnetic force can be suppressed.

In the forming device, the die magnetization suppressing part may be provided with a switching part that switches the direction of a DC current that is supplied to the electrode. The magnetization of the die can be cancelled by allowing a DC current in an opposite direction to flow to the electrode.

In the forming device, the die magnetization suppressing part may be provided with a coil surrounding the die. The magnetization of the die can be cancelled with a magnetic flux generated by the coil.

In the forming device, the coil may be provided to surround each of the upper die and the lower die. The magnetization of the die can be efficiently cancelled by providing the coil in both of the upper die and the lower die.

In the forming device, the upper die may be supported by an upper die holder, the lower die may be supported by a lower die holder, and the die magnetization suppressing part may be provided with a magnetic flux loop forming part including a protrusion extending from one of the upper die holder and the lower die holder toward the other at a position adjacent to the die. Accordingly, the concentration of a magnetic flux loop in the lower die and the upper die can be suppressed, and thus promotion of the magnetization of the die can be suppressed.

In the forming device, a protrusion provided on the outer surface side of at least one of the upper die holder and the lower die holder may form a leakage magnetic field suppressing part. Accordingly, it is possible to prevent a leakage magnetic field from affecting an external device with a simple configuration in which the die holder is provided with the protrusion.

Hereinafter, preferable embodiments of a forming device according to an aspect of the invention will be described with reference to the drawings. In the drawings, the same or similar parts will be denoted by the same reference signs, and overlapping description will be omitted.

First Embodiment

Configuration of Forming Device

Figure 2:
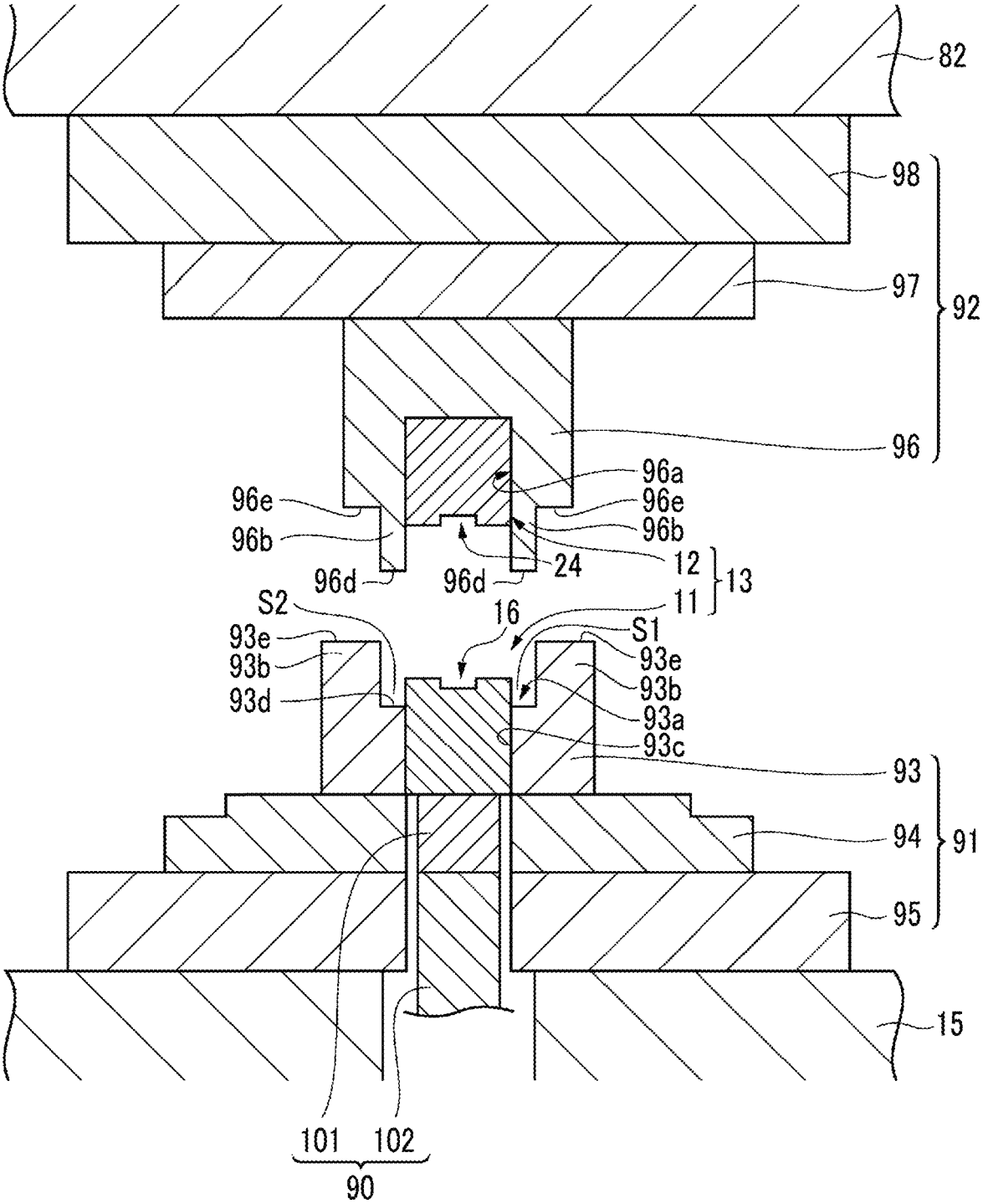
FIG. 2 is a transverse sectional view of a blow forming die and upper die and lower die holding parts, taken along the line II-II of FIG. 1.

FIG. 1 is a schematic diagram of a configuration of a forming device, and FIG. 2 is a transverse sectional view of a blow forming die and upper die and lower die holding parts, taken along the line II-II of FIG. 1. As shown in FIG. 1, a forming device 10 that forms a metal pipe 100 (see FIG. 5) is provided with a blow forming die 13 composed of a pair of a lower die 11 and an upper die 12, a lower die holding part 91 for holding the lower die 11, an upper die holding part 92 for holding the upper die 12, a driving mechanism 80 that moves at least one of the lower die holding part 91 holding the lower die 11 and the upper die holding part 92 holding the upper die 12 (here, upper die holding part 92), a pipe holding mechanism 30 that holds a metal pipe material 14 shown by the virtual line between the lower die 11 and the upper die 12, a heating mechanism 50 that energizes the metal pipe material 14 held by the pipe holding mechanism 30 to heat the metal pipe material, a gas supply part 60 for supplying a high-pressure gas (gas) into the metal pipe material 14 held and heated between the lower die 11 and the upper die 12, a pair of gas supply mechanisms (gas supply part) 40 for supplying a gas into the metal pipe material 14 held by the pipe holding mechanism 30 from the gas supply part 60, and a water circulation mechanism 72 that forcibly cools the blow forming die 13 with water. The forming device 10 according to this embodiment is provided with a lower die driving mechanism 90 that drives the lower die 11 in a vertical direction. In addition, the forming device 10 is provided with a controller 70 that controls driving of the driving mechanism 80, driving of the lower die driving mechanism 90, driving of the pipe holding mechanism 30, driving of the heating mechanism 50, and gas supply of the gas supply part 60.

The lower die 11 is fixed to a large base 15 via the lower die holding part 91. The lower die 11 is composed of a large steel block and is provided with a recessed part 16 in an upper surface thereof (a parting surface from the upper die 12). As shown in FIGS. 1 and 2, the lower die holding part 91 holding the lower die 11 is provided with a first lower die holder 93 holding the lower die 11, a second lower die holder 94 holding the first lower die holder 93, and a lower die base plate 95 holding the second lower die holder 94, that are laminated in order from the top. The lower die base plate 95 is fixed to the base 15. As shown in FIG. 1, lengths of the first lower die holder 93 and the second lower die holder 94 in an axial direction (lengths in the horizontal direction in FIG. 1) are almost the same as that of the lower die 11 in the axial direction.

An electrode storage space 11*a* is provided near each of right and left ends (right and left ends in FIG. 1) of the lower die 11, and a first electrode 17 and a second electrode 18 that are configured to advance or retreat in a vertical direction by an actuator (not shown) are provided in the electrode storage spaces 11*a*. Recessed grooves 17*a* and 18*a* having a semi-arc shape corresponding to an outer peripheral surface on the lower side of the metal pipe material 14 are formed in upper surfaces of the first electrode 17 and the second electrode 18, respectively (see FIG. 3C). The metal pipe material 14 can be placed to be well fitted in the recessed grooves 17*a* and 18*a*. In addition, in front surfaces of the first and second electrodes 17 and 18 (surfaces of the die in an outward direction), tapered recessed surfaces 17*b* and 18*b* are formed such that the vicinities thereof are recessed at an angle into a tapered shape toward the recessed grooves 17*a* and 18*a*, respectively. In addition, the lower die 11 has a cooling water passage 19 formed therein. On the lower surface side of the lower die 11, a lower die driving mechanism 90 extending in the vertical direction through the second lower die holder 94 and the lower die base plate 95 is provided. The lower die driving mechanism 90 is provided with a support part 101 supporting the lower surface of the lower die 11 and an axial part 102 extending downward from the support part 101. The lower end side of the axial part 102 is connected to a driving part (not shown).

The pair of first and second electrodes 17 and 18 positioned in the lower die 11 constitute the pipe holding mechanism 30, and can elevatably support the metal pipe material 14 between the upper die 12 and the lower die 11. The forming device 10 is provided with a thermocouple (not shown) for measuring the temperature of the metal pipe material 14. For example, the thermocouple may be inserted from the side of the die 13. The thermocouple is just an example of the temperature measuring unit, and a non-contact temperature sensor such as a radiation thermometer or an optical thermometer may be provided. A configuration without the temperature measuring unit may also be employed if the correlation between the energization time and the temperature can be obtained.

The upper die 12 is a large steel block that is provided with a recessed part 24 in a lower surface thereof (a parting surface from the lower die 11) and a cooling water passage 25 built therein. As shown in FIGS. 1 and 2, the upper die holding part 92 holding the upper die 12 is provided with a first upper die holder 96 holding the upper die 12, a second upper die holder 97 holding the first upper die holder 96, and an upper die base plate 98 holding the second upper die holder 97, that are laminated in order from the bottom. The upper die base plate 98 is fixed to a slide 82. As shown in FIG. 1, lengths of the first upper die holder 96 and the second upper die holder 97 in an axial direction (lengths in the horizontal direction in FIG. 1) are almost the same as that of the upper die 12 in the axial direction. The slide 82 to which the upper die holding part 92 is fixed is suspended by a pressing cylinder 26, and is guided by a guide cylinder 27 so as not to laterally vibrate.

Similarly to the case of the lower die 11, an electrode storage space 12*a* is provided near each of right and left ends (right and left ends in FIG. 1) of the upper die 12, and a first electrode 17 and a second electrode 18 that are configured to advance or retreat in the vertical direction by an actuator (not shown) are provided in the electrode storage spaces 12*a*. Recessed grooves 17*a* and 18*a* having a semi-arc shape corresponding to an outer peripheral surface on the upper side of the metal pipe material 14 are formed in lower surfaces of the first and second electrodes 17 and 18, respectively (see FIG. 3C), and the metal pipe material 14 can be well fitted in the recessed grooves 17*a* and 18*a*. In addition, in front surfaces of the first and second electrodes 17 and 18 (surfaces of the die in an outward direction), tapered recessed surfaces 17*b* and 18*b* are formed such that the vicinities thereof are recessed at an angle into a tapered shape toward the recessed grooves 17*a* and 18*a*, respectively. Accordingly, in a case where the pair of first and second electrodes 17 and 18 positioned in the upper die 12 also constitute the pipe holding mechanism 30 and the metal pipe material 14 is sandwiched between the upper and lower pairs of first and second electrodes 17 and 18 from the vertical direction, the metal pipe material 14 can be surrounded such that the outer periphery thereof firmly adheres well over the whole periphery. The fixing parts of the respective actuators moving the first electrode 17 and the second electrode 18 corresponding to a moving part up and down are held and fixed to the lower die holding part 91 and the upper die holding part 92, respectively.

The driving mechanism 80 is provided with a slide 82 that moves the upper die 12 and the upper die holding part 92 so as to combine the upper die 12 and the lower die 11 together, a driving part 81 that generates a driving force for moving the slide 82, and a servo motor 83 that controls a fluid amount with respect to the driving part 81. The driving part 81 is composed of a fluid supply part that supplies a fluid (an operating oil in a case where a hydraulic cylinder is employed as the pressing cylinder 26) for driving the pressing cylinder 26 to the pressing cylinder 26.

The controller 70 can control the movement of the slide 82 by controlling the amount of the fluid to be supplied to the pressing cylinder 26 by controlling the servo motor 83 of the driving part 81. The driving part 81 is not limited to a part that applies a driving force to the slide 82 via the pressing cylinder 26 as described above. For example, the driving part may be mechanically connected to the slide 82 to directly or indirectly apply a driving force generated by the servo motor 83 to the slide 82. For example, a driving mechanism having an eccentric shaft, a driving source (for example, a servo motor and a reducer) that applies a rotating force for rotating the eccentric shaft, and a converter (for example, a connecting rod or an eccentric sleeve) that converts the rotational movement of the eccentric shaft into the linear movement to move the slide may be employed. In this embodiment, the driving part 81 may not have the servo motor 83.

As shown in FIG. 2, an upper end surface of the lower die 11 and a lower end surface of the upper die 12 are uneven. Specifically, the recessed part 16 with a rectangular cross-sectional shape is formed at the center of the upper end surface of the lower die 11, and the recessed part 24 with a rectangular cross-sectional shape is formed at the center of the lower end surface of the upper die 12 to be opposed to the recessed part 16 of the lower die 11.

The first lower die holder 93 that constitutes the lower die holding part 91 and holds the lower die 11 is provided with a recessed part 93*a* with a rectangular cross-sectional shape at a center of an upper end surface 93*e* of the rectangular parallelepiped. The lower die 11 is held such that the substantially lower half thereof is fitted into a gap 93*c* provided at the center of a bottom surface 93*d* of the recessed part 93*a* and dividing the first lower die holder 93. Spaces S1 and S2 are respectively provided between protrusions 93*b* at both sides that form the recessed part 93*a* of the first lower die holder 93 and side surfaces of the substantially upper half of the lower die 11 that protrude higher than the bottom surface 93*d* of the first lower die holder 93, and protrusions 96*b* of the first upper die holder 96 to be described later proceed into the spaces S1 and S2 in a case where the blow forming die 13 is closed.

The first upper die holder 96 that constitutes the upper die holding part 92 and holds the upper die 12 is formed into a stepped block shape, in which the rectangular parallelepiped becomes smaller downward in a stepwise manner, by forming two steps toward the lower side from the upper side at both sides of the rectangular parallelepiped. A recessed part 96*a* with a rectangular cross-sectional shape is formed at a center of a lower end surface 96*d* of the first upper die holder 96, and the upper die 12 is held to be housed in the recessed part 96*a*. Accordingly, inner surfaces of the protrusions 96*b* at both sides that form the recessed part 96*a* of the first upper die holder 96 are brought into contact with the side surfaces of the upper die 12. In addition, the protrusions 96*b* protrude downward from the lower end surface of the upper die 12 by a predetermined length, and respectively proceed into the spaces S1 and S2 of the first lower die holder 93 in a case where the blow forming die 13 is closed. In addition, in a case where the blow forming die 13 is closed, the lower end surface (tip end surface) 96*d* of the protrusion 96*b* of the first upper die holder 96 is brought into contact with the bottom surface 93*d* of the recessed part 93*a* of the first lower die holder 93, and step surfaces 96*e* that form the protrusions 96*b* at both sides of the protrusions 96*b* of the first upper die holder 96 and are positioned above the protrusions 96*b* are brought into contact with the upper end surfaces 93*e* of the protrusions 93*b* of the first lower die holder 93.

As shown in FIG. 1, the heating mechanism 50 has the first and second electrodes 17 and 18, a power supply 51, conductive wires 52 that extend from the power supply 51 and are connected to the first and second electrodes 17 and 18, and a switch 53 that is provided in the conductive wire 52. The controller 70 controls the heating mechanism 50, and thus the metal pipe material 14 can be heated to a quenching temperature (equal to or higher than an AC3 transformation temperature).

Figure 3A:
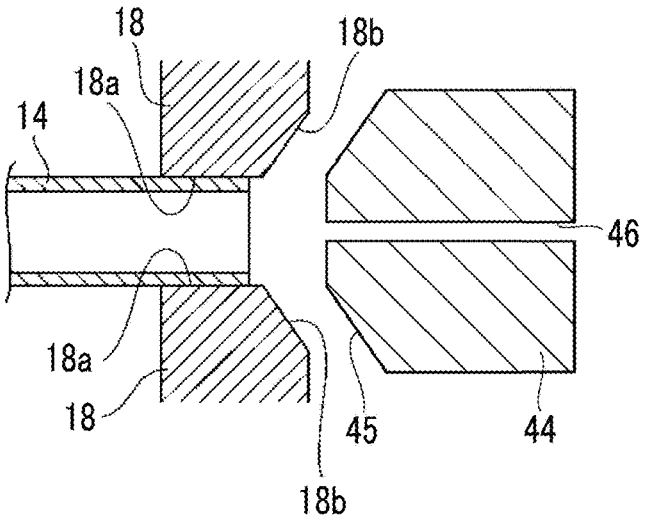
FIGS. 3A to 3C are enlarged views of the vicinity of electrodes.
Figure 3B:
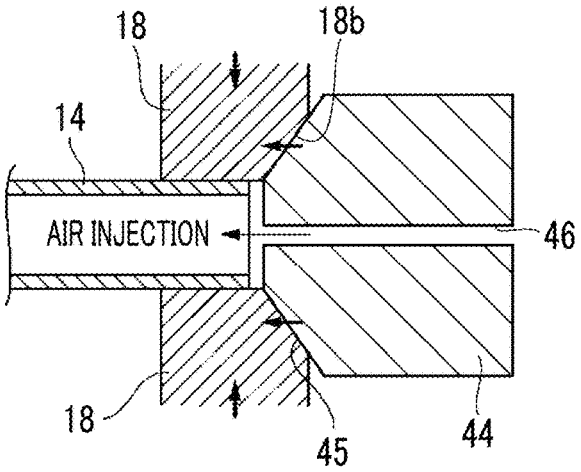
Figure 3C:
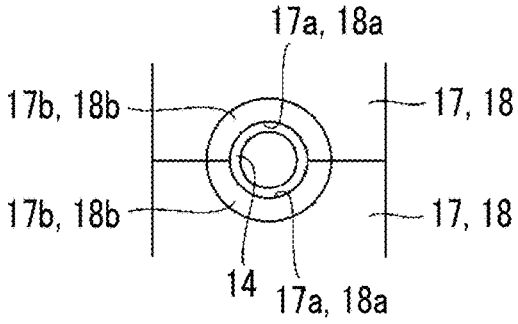

Each of the pair of gas supply mechanisms 40 has a cylinder unit 42, a cylinder rod 43 that advances or retreats in accordance with the operation of the cylinder unit 42, and a sealing member 44 that is connected to a tip end of the cylinder rod 43 on the side of the pipe holding mechanism 30. The cylinder unit 42 is placed and fixed on the base 15 via a block 41. A tapered surface 45 is formed at a tip end of the sealing member 44 so as to be tapered. The tapered surfaces are formed into such a shape as to be well fitted in and brought into contact with the tapered recessed surfaces 17*b* and 18*b* of the first and second electrodes 17 and 18 (see FIGS. 3A to 3C). The sealing member 44 is provided with a gas passage 46 that extends from the cylinder unit 42 toward the tip end, specifically, through which a high-pressure gas supplied from the gas supply part 60 flows as shown in FIGS. 3A and 3B.

As shown in FIG. 1, the gas supply part 60 includes a high-pressure gas supply 61, an accumulator 62 that stores a gas supplied by the high-pressure gas supply 61, a first tube 63 that extends from the accumulator 62 to the cylinder unit 42 of the gas supply mechanism 40, a pressure control valve 64 and a switching valve 65 that are provided in the first tube 63, a second tube 67 that extends from the accumulator 62 to the gas passage 46 formed in the sealing member 44, and a pressure control valve 68 and a check valve 69 that are provided in the second tube 67. The pressure control valve 64 functions to supply, to the cylinder unit 42, a gas having an operation pressure adapted for the pressing force of the sealing member 44 with respect to the metal pipe material 14. The check valve 69 functions to prevent the high-pressure gas from flowing backward in the second tube 67.

The controller 70 controls the pressure control valve 68 of the gas supply part 60, and thus a gas having a desired operation pressure can be supplied into the metal pipe material 14. In addition, the controller 70 acquires temperature information from the thermocouple (not shown), and controls the pressing cylinder 26 and the switch 53.

The water circulation mechanism 72 includes a water tank 73 that stores water, a water pump 74 that draws up and pressurizes the water stored in the water tank 73 to send the water to the cooling water passage 19 of the lower die 11 and the cooling water passage 25 of the upper die 12, and a pipe 75. Although omitted, a cooling tower that lowers the water temperature or a filter that purifies the water may be provided in the pipe 75.

Method of Forming Metal Pipe Using Forming Device

Figures 4A, 4B:
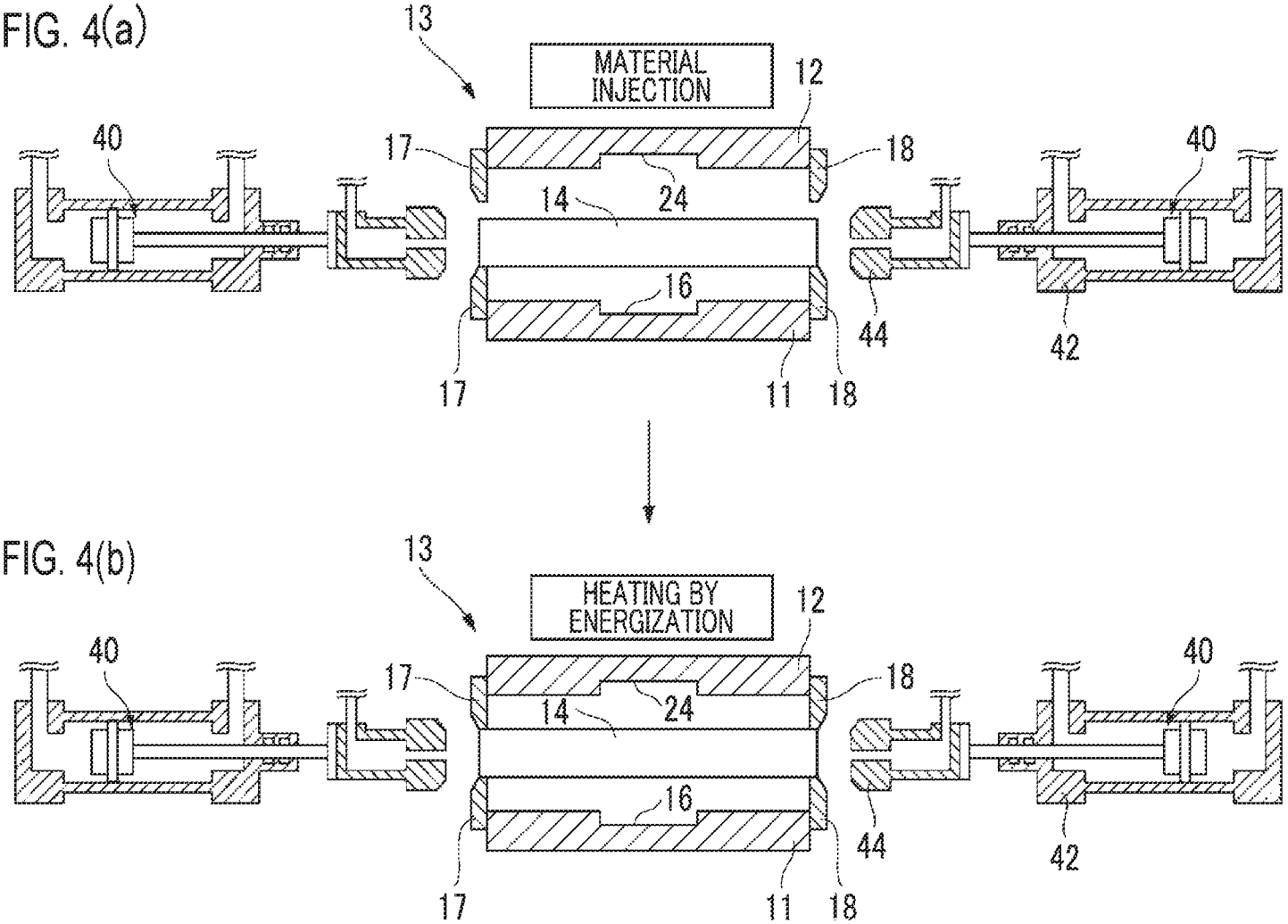
FIGS. 4(*a*) and 4(*b*) are diagrams showing a manufacturing step using the forming device.
Figure 5:
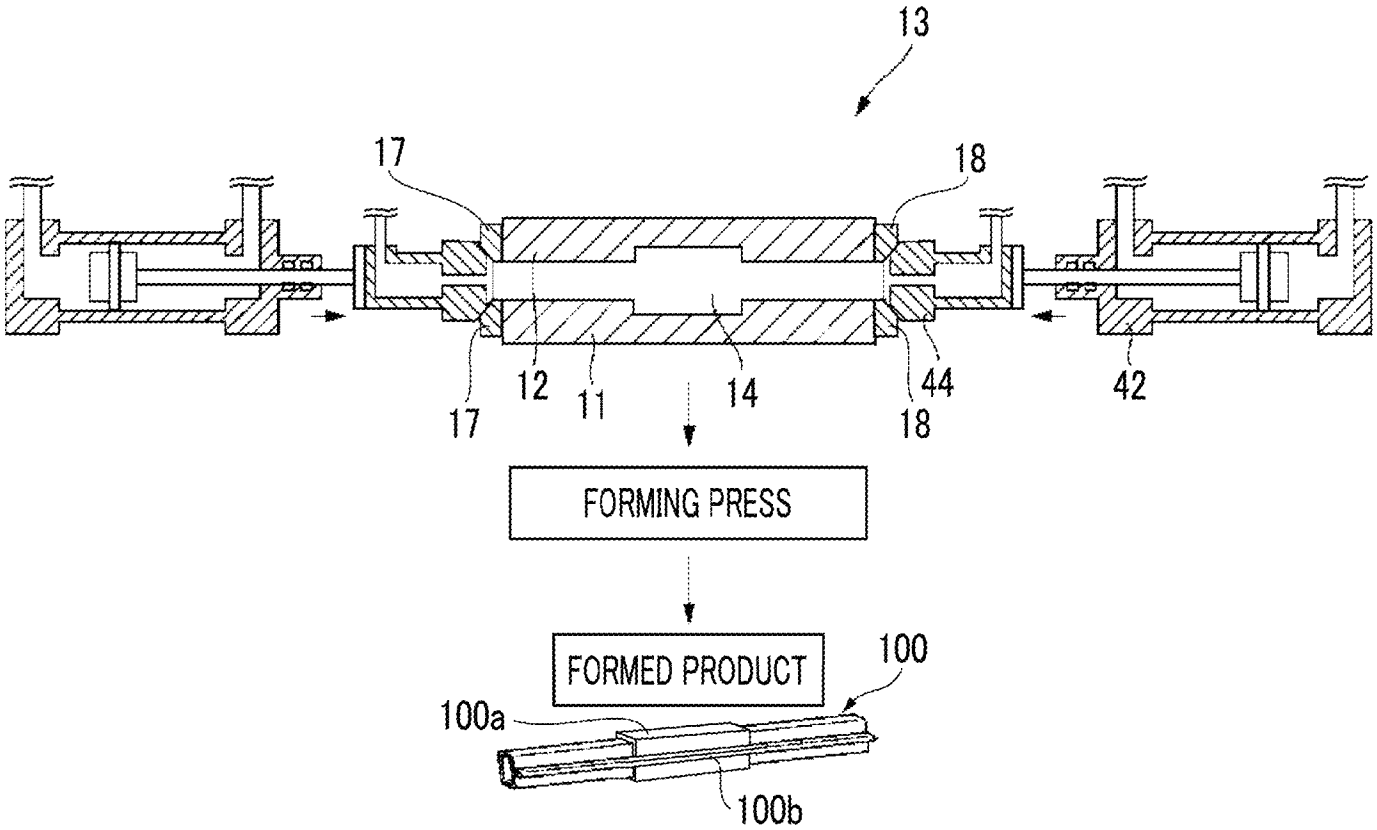
FIG. 5 is a diagram showing a manufacturing step following the steps in FIGS. 4(*a*) and 4(*b*).

Next, a method of forming a metal pipe using the forming device 10 will be described. FIGS. 4(*a*) and 4 (*b*) show steps from a pipe injection step for injecting the metal pipe material 14 as a material to an energization and heating step for heating the metal pipe material 14 by energization. More specifically, FIG. 4(*a*) is a diagram showing a state in which the metal pipe material is set in the die. FIG. 4(*b*) is a diagram showing a state in which the metal pipe material is held by the electrodes. FIG. 5 is a diagram showing a manufacturing step following the steps in FIGS. 4(*a*) and 4 (*b*).

First, a metal pipe material 14 that is a quenchable steel type is prepared. As shown in FIG. 4 (*a*), the metal pipe material 14 is placed (injected) on the first and second electrodes 17 and 18 provided in the lower die 11 using, for example, a robot arm or the like. Since the first and second electrodes 17 and 18 have the recessed grooves 17*a* and 18*a*, respectively, the metal pipe material 14 is positioned by the recessed grooves 17*a* and 18*a*. Next, the controller 70 (see FIG. 1) controls the pipe holding mechanism 30 to hold the metal pipe material 14 by the pipe holding mechanism 30. Specifically, as in FIG. 4 (*b*), an actuator (not shown) that allows the first and second electrodes 17 and 18 to advance or retreat is operated such that the first and second electrodes 17 and 18 positioned on the upper and lower sides, respectively, are brought closer to and into contact with each other. Due to this contact, both of the end parts of the metal pipe material 14 are sandwiched between the first and second electrodes 17 and 18 from the upper and lower sides. In addition, due to the presence of the recessed grooves 17*a* and 18*a* formed in the first and second electrodes 17 and 18, the metal pipe material 14 is sandwiched so as to firmly adhere over the whole periphery thereof.

Next, as shown in FIG. 1, the controller 70 controls the heating mechanism 50 to heat the metal pipe material 14. Specifically, the controller 70 turns on the switch 53 of the heating mechanism 50. In that case, electric power is supplied from the power supply 51 to the metal pipe material 14, and the metal pipe material 14 produces heat (Joule heat) due to the resistance present in the metal pipe material 14. In this case, the measurement value of the thermocouple is always monitored, and based on the results thereof, the energization is controlled and the cylinder unit 42 of the gas supply mechanism 40 is operated. Accordingly, both ends of the metal pipe material 14 are sealed by the sealing member 44 (see also FIGS. 3A to 3C).

Figure 6:
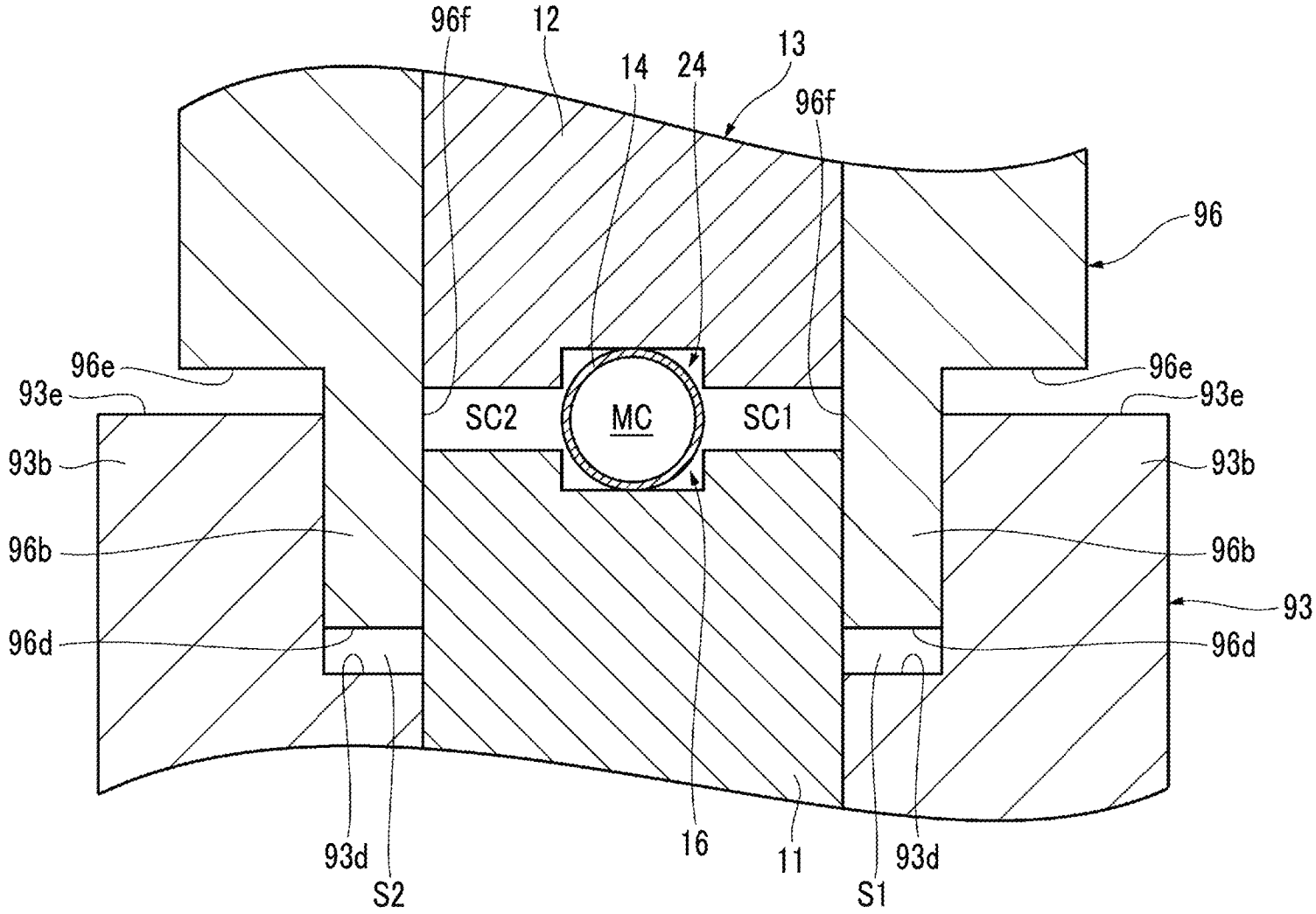
FIG. 6 is a diagram showing operations of the blow forming die and an upper die holder and a change in shape of the metal pipe material.
Figure 7:
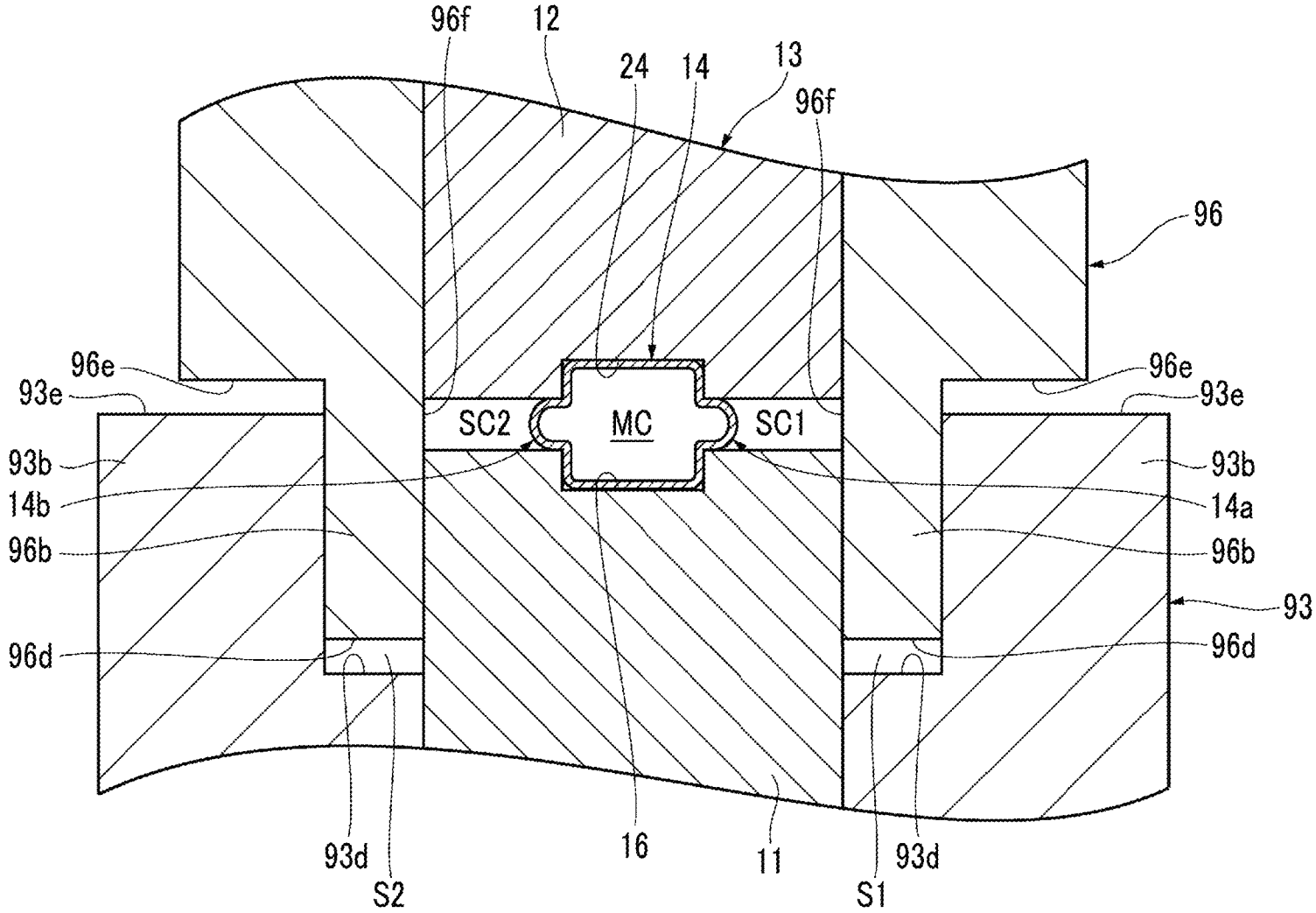
FIG. 7 is a diagram following FIG. 6.
Figure 8:
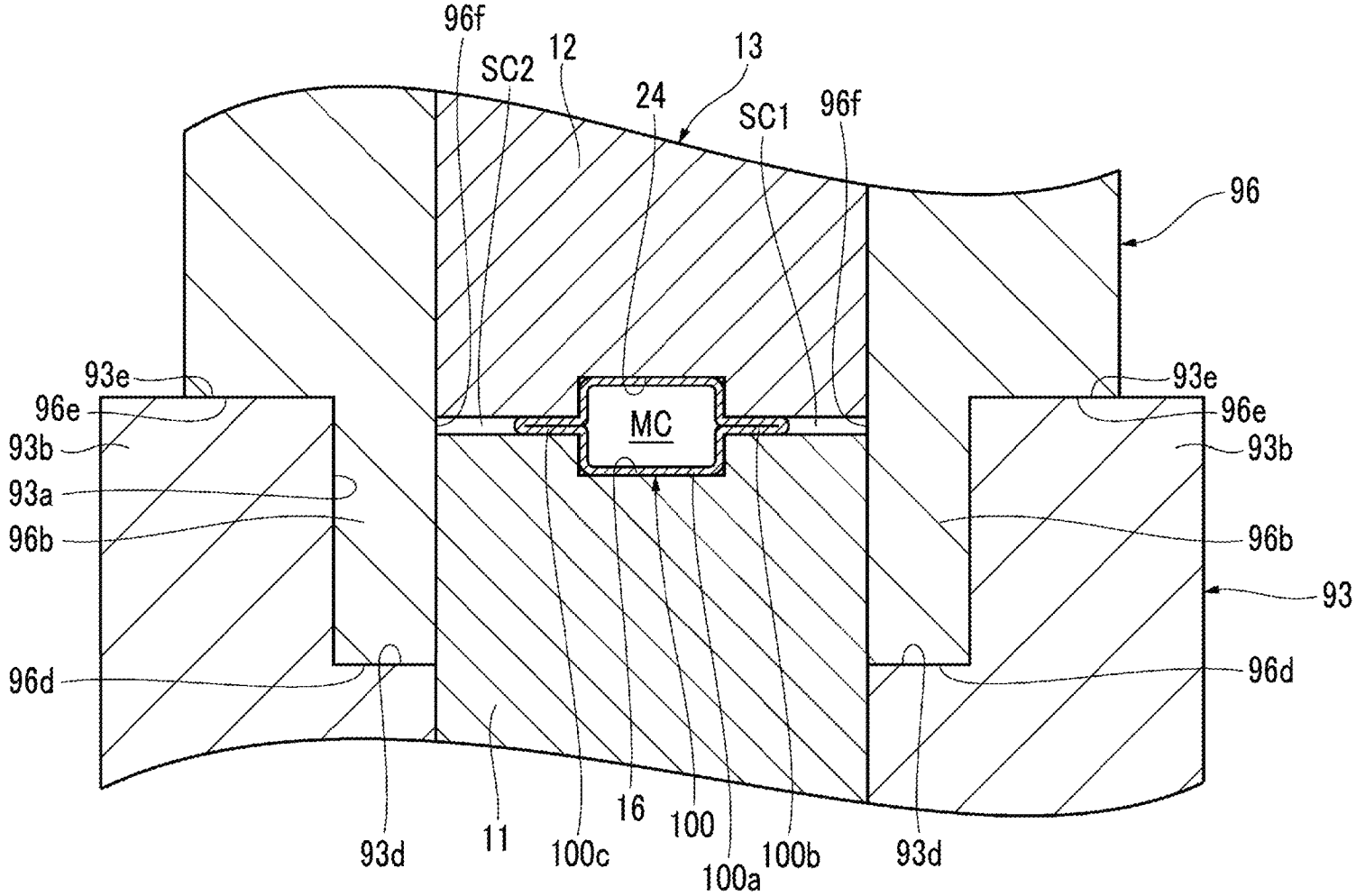
FIG. 8 is a diagram following FIG. 7.

FIG. 6 is a diagram showing operations of the blow forming die and the first upper die holder and a change in shape of the metal pipe material. FIG. 7 is a diagram following FIG. 6. FIG. 8 is a diagram following FIG. 7.

As shown in FIG. 6, the blow forming die 13 is closed with respect to the metal pipe material 14 after heating. In this case, the protrusions 96*b* of the first upper die holder 96 proceed into the spaces S1 and S2 of the first lower die holder 93, and between the recessed part 16 of the lower die 11 and the recessed part 24 of the upper die 12, a main cavity part MC with a substantially rectangular cross-sectional shape is formed that is a gap for forming a pipe part (main body part) 100*a*. With this, sub-cavity parts SC1 and SC2 that communicate with the main cavity part MC and are gaps for forming flange parts 100*b* and 100*c* are respectively formed at both sides of the main cavity part MC between the upper end surface of the lower die 11 and the lower end surface of the upper die 12.

Here, the sub-cavity parts SC1 and SC2 between the upper end surface of the lower die 11 and the lower end surface of the upper die 12 extend to be opened to the outside of the die. The sub-cavity parts SC1 and SC2 are blocked from the outside by inner surfaces 96*f* of the protrusions 96*b* of the first upper die holder 96. The protrusions 96*b* of the first upper die holder 96, blocking the sub-cavity parts SC1 and SC2 from the outside of the die, are operated such that foreign matter such as fragments generated when, for example, the metal pipe bursts in the die is prevented from advancing out of the die through the sub-cavity parts SC1 and SC2 and from being discharged. Accordingly, the first upper die holder 96 having the protrusions 96*b* also functions as a shielding member.

In this state, that is, in a state before the blow forming die is completely closed, the metal pipe material 14 is fitted in the main cavity part MC, and in a state in which the metal pipe material is in contact with the bottom surface of the recessed part 16 of the lower die 11 and the bottom surface of the recessed part 24 of the upper die 12, a high-pressure gas is supplied into the metal pipe material 14 by the gas supply part 60 to start blow forming.

Here, since the metal pipe material 14 is softened by being heated at a high temperature (about 950° C.), the gas supplied into the metal pipe material 14 is thermally expanded. Therefore, for example, with the use of compressed air as a gas to be supplied, the metal pipe material 14 at 950° C. can be easily expanded by thermally expanded compressed air.

In parallel with this, the blow forming die 13 is further closed, and as shown in FIG. 7, the main cavity part MC and the sub-cavity parts SC1 and SC2 are further narrowed between the lower die 11 and the upper die 12.

Accordingly, the metal pipe material 14 is expanded in the main cavity part MC so as to follow the recessed parts 16 and 24, and parts (both side parts) 14*a* and 14*b* of the metal pipe material 14 are expanded so as to enter into the sub-cavity parts SC1 and SC2, respectively.

As shown in FIG. 8, the blow forming die 13 is further closed, and thus the lower end surface 96*d* of the protrusion 96*b* of the first upper die holder 96 is brought into contact with the bottom surface 93*d* of the recessed part 93*a* of the first lower die holder 93, the step surface 96*e* of the first upper die holder 96 is brought into contact with the upper end surface 93*e* of the protrusion 93*b* of the first lower die holder 93, and the inner surface of the protrusion 93*b* of the first lower die holder 93 and the outer surface of the protrusion 96*b* of the first upper die holder 96 are brought into contact with each other. In a state in which the first lower die holder 93 and the first upper die holder 96 are firmly adhered to each other, the closing of the blow forming die 13 is completed.

In this case, the main cavity part MC and the sub-cavity parts SC1 and SC2 are further narrowed than in the state shown in FIG. 7, and in this state, the sub-cavity parts SC1 and SC2 are blocked from the outside by the inner surfaces 96*f* of the protrusions 96*b* of the first upper die holder 96 as described above.

Accordingly, the metal pipe material 14 softened by heating and supplied with the high-pressure gas is formed as the pipe part 100*a* with a rectangular cross-sectional shape following the rectangular cross-sectional shape of the main cavity part MC in the main cavity part MC, and formed as the flange parts 100*b* and 100*c* with a rectangular cross-sectional shape in which a part of the metal pipe material 14 is folded in the sub-cavity parts SC1 and SC2.

In this blow forming, quenching is performed in such a way that the outer peripheral surface of the metal pipe material 14 expanded by being subjected to the blow forming is brought into contact with the recessed part 16 of the lower die 11 so as to be rapidly cooled, and simultaneously, brought into contact with the recessed part 24 of the upper die 12 so as to be rapidly cooled (since the upper die 12 and the lower die 11 have a large heat capacity and are managed at a low temperature, the heat of the pipe surface is taken to the dies at once in a case where the metal pipe material 14 is brought into contact with the dies.). Such a cooling method is referred to as die contact cooling or die cooling. Immediately after the rapid cooling, the austenite is transformed to martensite (hereinafter, transformation of austenite to martensite will be referred to as martensite transformation). Since the cooling rate is reduced in the second half of the cooling, the martensite is transformed to another structure (troostite, sorbate, or the like) owing to recuperation. Therefore, there is no need to perform a separate tempering treatment. In this embodiment, in place of or in addition to the die cooling, a cooling medium may be supplied to the metal pipe 100 to perform cooling. For example, the metal pipe material 14 may be brought into contact with the die (upper die 12 and lower die 11) to be cooled until the temperature is lowered to a temperature at which the martensite transformation starts, and then, the die may be opened and a cooling medium (gas for cooling) may be allowed to flow to the metal pipe material 14 to cause the martensite transformation. In this description, the description is made using a case where the metal pipe material 14 is steel as an example.

By the above-described forming method, the metal pipe 100 having the pipe part 100*a* and the flange parts 100*b* and 100*c* can be obtained as a formed product as shown in FIG. 5. In this embodiment, since the main cavity part MC is configured to have a rectangular cross-sectional shape, the metal pipe material 14 is subjected to the blow forming in accordance with the shape, and thus the pipe part 100*a* is formed into a rectangular cylindrical shape. The shape of the main cavity part MC is not particularly limited. In accordance with a desired shape, any shape may be employed such as a circular cross-sectional shape, an elliptical cross-sectional shape, or a polygonal cross-sectional shape.

Figure 9:
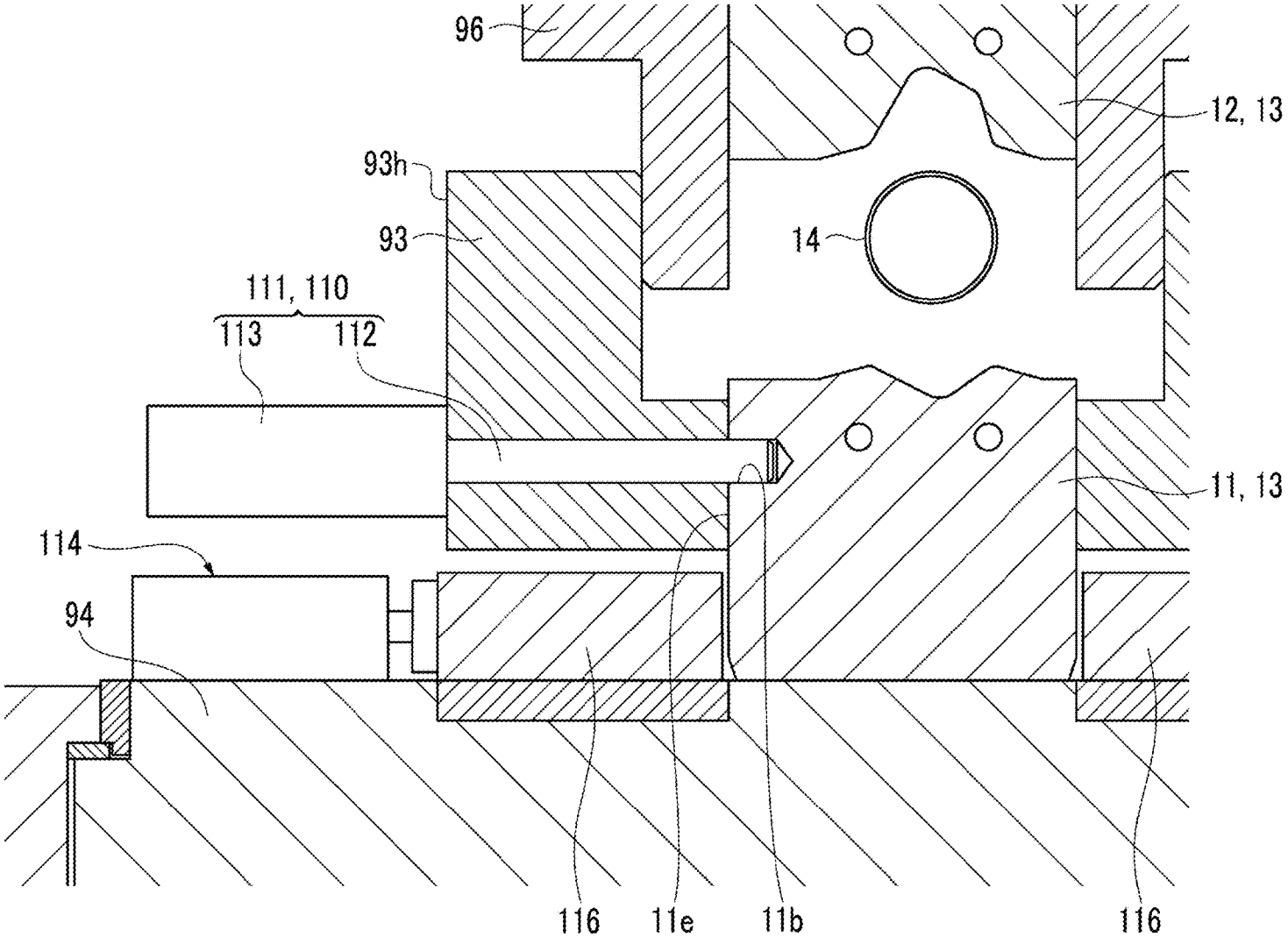
FIG. 9 is an enlarged cross-sectional view showing the positional relationship between the respective members during the heating by energization.
Figure 10:
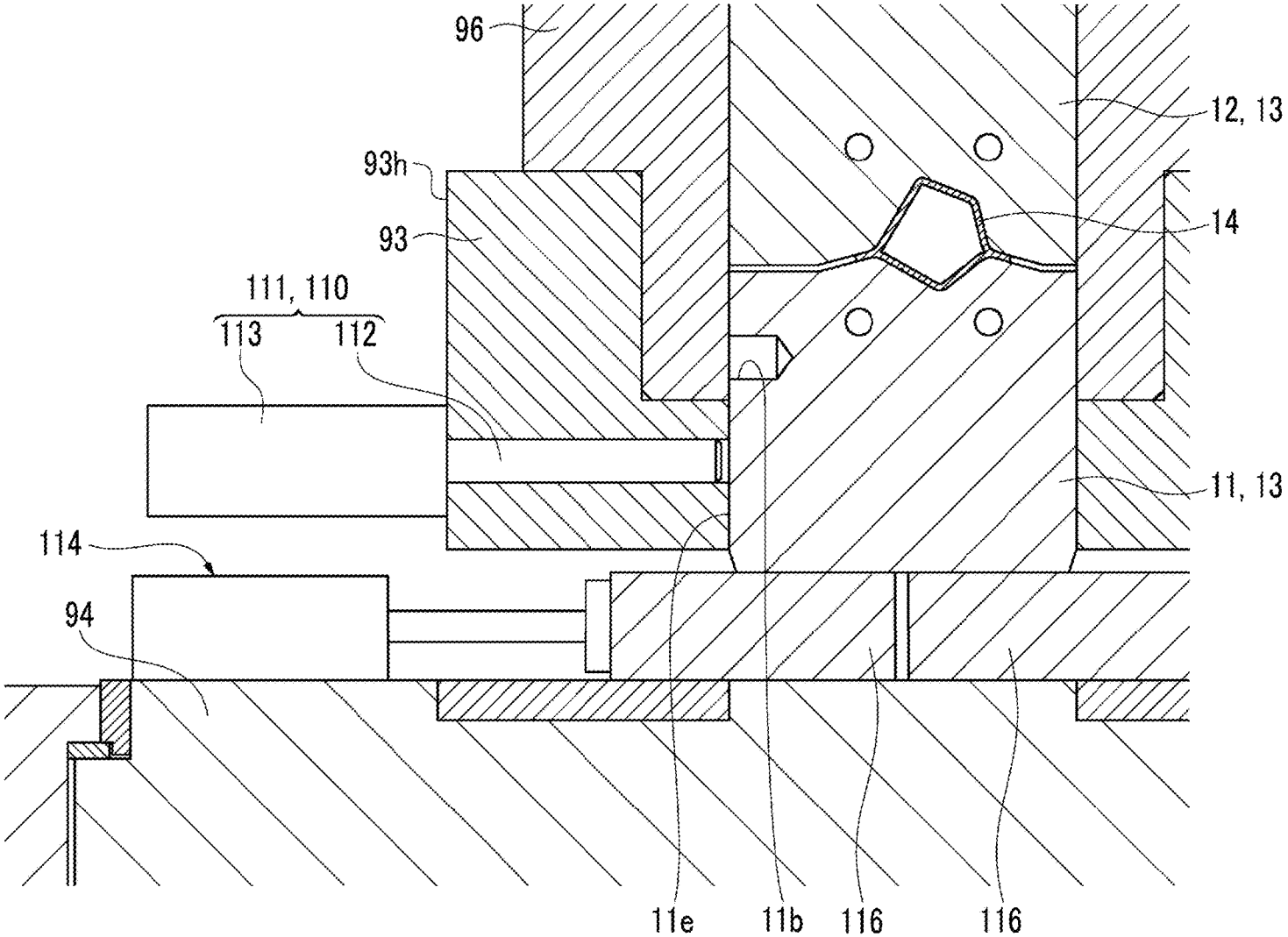
FIG. 10 is an enlarged cross-sectional view showing the positional relationship between the respective members during the forming.

Next, a configuration of a die movement suppressing part 110 of the forming device 10 according to this embodiment will be described with reference to FIGS. 9 and 10. FIG. 9 is an enlarged cross-sectional view showing the positional relationship between the respective members during the heating by energization. FIG. 10 is an enlarged cross-sectional view showing the positional relationship between the respective members during the forming. In the forming device 10, in a case where the metal pipe material 14 is heated by energization of the electrodes 17 and 18, the die 13 or a member around the die may be magnetized (for example, see magnetic flux loops MP1 and MP2 of FIG. 13 to be described later). In such a case, while the metal pipe material 14 is heated by energization, an electromagnetic force may act on the magnetized die 13 such that the die 13 is moved in a sliding direction that is a moving direction of the die 13. In a case where the die 13 is moved by the electromagnetic force acting thereon and brought into contact with the metal pipe material 14 during the heating by energization, electrical leakage may be caused via the die 13 and the device may be damaged. Accordingly, the forming device 10 according to this embodiment is provided with the die movement suppressing part 110 that suppresses the movement of the die 13 by the electromagnetic force at least when the energization to the metal pipe material 14 is performed by the electrodes 17 and 18.

As shown in FIGS. 9 and 10, the die movement suppressing part 110 is provided with a fixing part 111 that mechanically fixes the lower die 11 at least when the energization to the metal pipe material 14 is performed by the electrodes 17 and 18. The fixing part 111 is provided with a pin 112 that is inserted into a side surface 11*e* of the lower die 11 at least when the energization to the metal pipe material 14 is performed by the electrode 17 and a driving part 113 that drives the pin 112. The fixing part 111 is attached to a side surface 93*h* on the outer side of the first lower die holder 93. The position where the fixing part 111 is attached and the number of fixing parts are not particularly limited, and the fixing part 111 may be provided at a plurality of positions in the first lower die holder 93.

The pin 112 is a rod-like member which is disposed vertically with respect to the side surface 11*e* of the lower die 11 and is driven to advance or retreat in the axial direction. A tip end part of the pin 112 is disposed at a position opposed to a recessed part 11*b* formed in the side surface 11*e* of the lower die 11 when the energization to the metal pipe material 14 is performed by the electrodes 17 and 18 (see FIG. 9). The pin 112 is inserted into the recessed part 11*b* through the first lower die holder 93.

The driving part 113 applies a driving force in the axial direction to the pin 112. The driving part 113 is fixed to the side surface 93*h* of the first lower die holder 93. The driving system of the driving part 113 is not particularly limited, and a compressed air type actuator, a hydraulic actuator, or an electric actuator may be employed. The driving part 113 is a part for inserting the pin 112 into the recessed part 11*b*, and since a large driving force is not required, a compressed air type cylinder rod that is easy to handle may be used.

Such a fixing part 111 drives the pin 112 by the driving part 113 and inserts the pin 112 into the recessed part 11*b* of the lower die 11 when the energization to the metal pipe material 14 is performed by the electrodes 17 and 18 (see FIGS. 4(*a*), 4(*b*), and 5). In a case where the heating by energization is completed, the fixing part 111 drives the pin 112 by the driving part 113 to remove the pin 112 from the recessed part 11*b* of the lower die 11 to thereby release the fixing. Then, the upper die 12 is moved downward with the upward movement of the lower die 11, and the forming of the metal pipe material 14 is started. After the lower die 11 is moved upward, a support member 116 is disposed between the lower surface of the lower die 11 and the upper surface of the second lower die holder 94 by an actuator 114. Accordingly, the lower die 11 during the forming is supported by the support member 116.

As described above, according to the forming device 10 according to this embodiment, the die movement suppressing part 110 suppresses the movement of the die 13 by an electromagnetic force at least when the energization to the metal pipe material 14 is performed by the electrodes 17 and 18. That is, even in a case where a mechanism that heats the metal pipe material 14 by energization of the electrodes 17 and 18 is provided, it is possible to suppress the movement of the die 13 toward the metal pipe material 14 by an electromagnetic force. Accordingly, electrical leakage can be prevented from occurring due to the contact between the die 13 and the metal pipe material 14 during the heating by energization, and stability can be improved.

In the forming device 10 according to this embodiment, the die movement suppressing part 110 is provided with the fixing part 111 that mechanically fixes the lower die 11 at least when the energization to the metal pipe material 14 is performed by the electrodes 17 and 18. In a case where the fixing part 111 mechanically fixes the lower die 11 that is easily moved by an electromagnetic force, the movement of the lower die 11 can be securely suppressed.

In the forming device 10 according to this embodiment, the fixing part 111 is provided with the pin 112 that is inserted into the side surface 11*e* of the lower die 11 at least when the energization to the metal pipe material 14 is performed by the electrodes 17 and 18. By employing a configuration in which the pin 112 is inserted from the side surface 11*e* of the lower die 11, the fixing part 111 can be simply configured, and interference with another mechanism can be avoided.

The configuration of the fixing part ill is not particularly limited as long as the fixing part can mechanically fix the lower die 11. For example, a fixing part that fixes the lower die 11 from the lower side may be employed. For example, a mechanism that is inserted into the lower die 11 from the lower side, and then bent in a horizontal direction may be provided. Otherwise, a mechanism that obliquely inserts a pin from the lower side of the lower die to the upper side may be employed. In addition, a configuration in which a pin is inserted in a longitudinal direction of the lower die 11 so as to avoid interference with a gas supply mechanism 40 may be employed.

Second Embodiment

Figure 11:
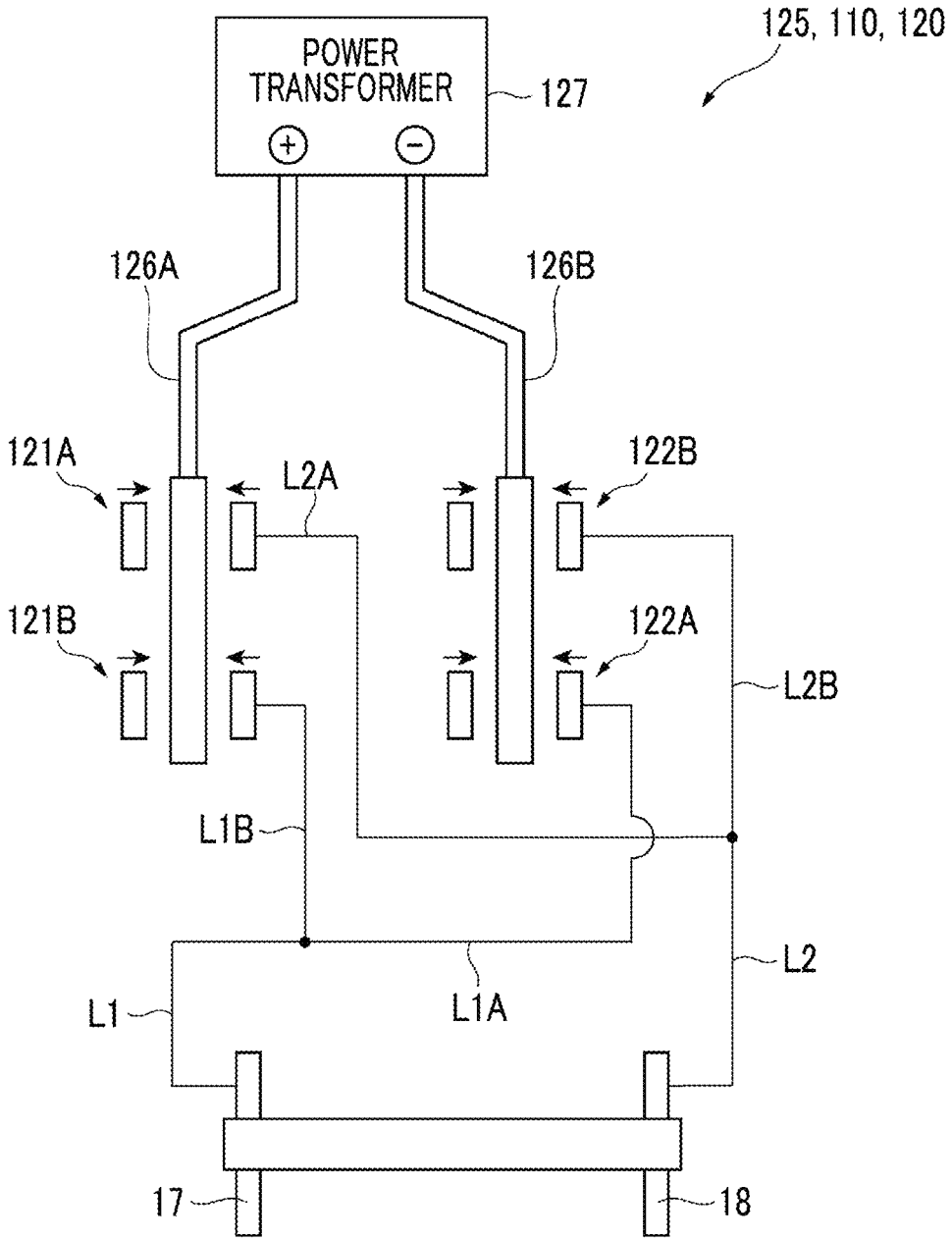
FIG. 11 is a schematic diagram showing a configuration of a switching part of a forming device according to a second embodiment.

In a forming device 10 according to a second embodiment of the invention, a die movement suppressing part 110 is provided with a die magnetization suppressing part 120 that suppresses the movement of a die 13 by an electromagnetic force by suppressing the magnetization of the die 13. In addition, as shown in FIG. 11, in the forming device 10 according to the second embodiment, the die magnetization suppressing part 120 is provided with a switching part 125 that switches the direction of a DC current that is supplied to electrodes 17 and 18. The switching part 125 shown in FIG. 11 is incorporated in the forming device 10 shown in FIG. 1.

As shown in FIG. 11, the switching part 125 can switch connection points of the first electrodes 17 and the second electrodes 18 on the side of a positive electrode 126A and on the side of a negative electrode 126B of a power transformer 127. That is, the switching part 125 performs switching between a state in which the first electrode 17 is connected to the positive electrode 126A and the second electrode 18 is connected to the negative electrode 126B and a state in which the second electrode 18 is connected to the positive electrode 126A and the first electrode 17 is connected to the negative electrode 126B. The switching part 125 may perform switching during the heating by energization, for every heating by energization, or for every plural heating operations by energization. The switching by the switching part 125 may be performed automatically by a controller, or may be performed by an operation of an operator.

Specifically, the switching part 125 is provided with clamps 121A and 121B allowing the connection or release of the power transformer 127 with respect to the positive electrode 126A and clamps 122A and 122B allowing the connection or release of the power transformer 127 with respect to the negative electrode 126B. The respective clamps 121A, 121B, 122A, and 122B are opened or closed by an actuator. From a line L1 connected to the first electrode 17, a line L1A is branched and connected to the clamp 122A, and a line L1B is branched and connected to the clamp 121B. From a line L2 connected to the second electrode 18, a line L2A is branched and connected to the clamp 121A, and a line L2B is branched and connected to the clamp 122B.

The switching part 125 connects the clamp 121B to the positive electrode 126A, and connects the clamp 122B to the negative electrode 126B in a case where the first electrode 17 is connected to the positive electrode 126A and the second electrode 18 is connected to the negative electrode 126B. The switching part 125 connects the clamp 121A to the positive electrode 126A, and connects the clamp 122A to the negative electrode 126B in a case where the second electrode 18 is connected to the positive electrode 126A and the first electrode 17 is connected to the negative electrode 126B.

Figure 12A:
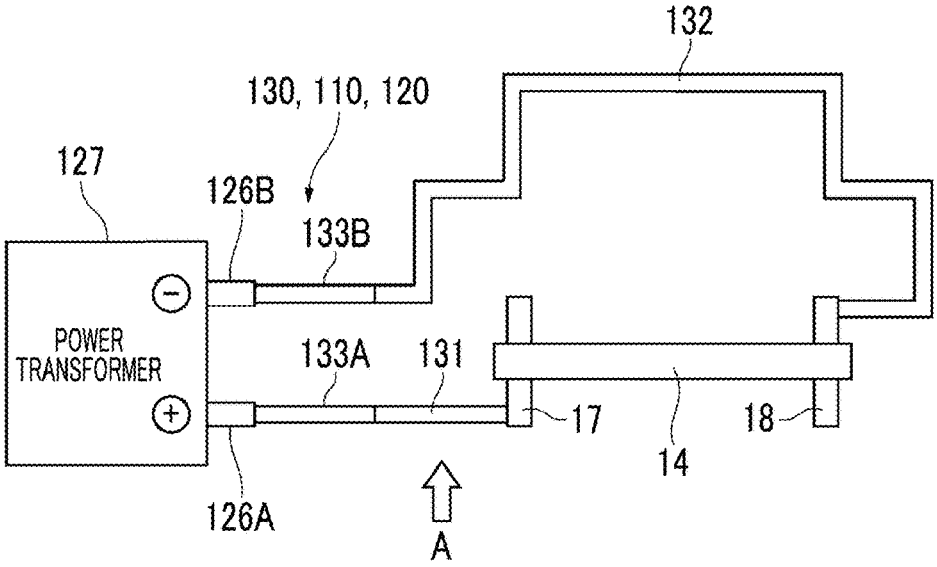
FIGS. 12A to 12C are schematic diagrams showing a configuration of the switching part of the forming device according to the second embodiment.
Figure 12B:
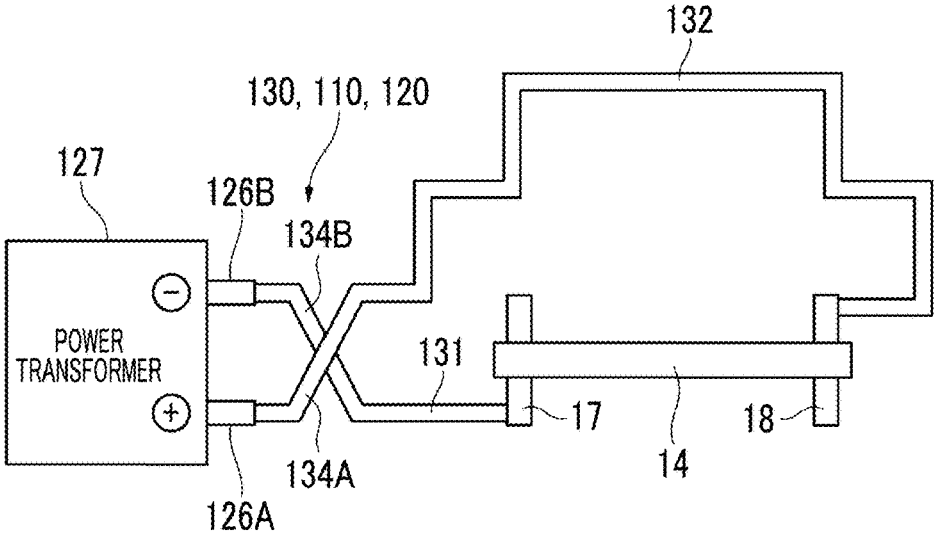

Otherwise, a switching part 130 shown in FIGS. 12A and 12B may be employed. The switching part 130 performs connection switching between a bus bar 131 drawn from a first electrode 17 and a bus bar 132 drawn from a second electrode 18 and between a positive electrode 126A and a negative electrode 126B of a power transformer 127.

Figure 12C:
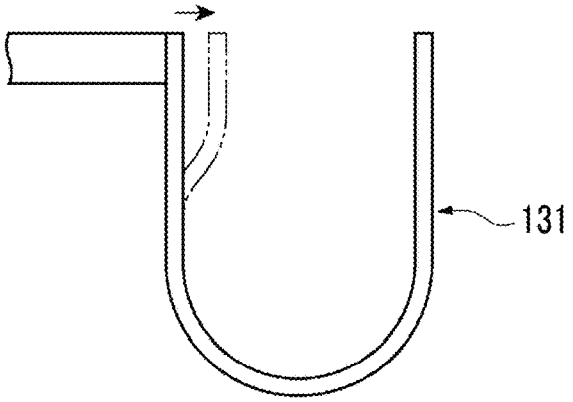

The power transformer 127 is disposed on the side of the first electrode 17. Accordingly, the bus bar 132 drawn from the second electrode 18 extends toward the power transformer 127 while bypassing a die 13, a die holder, and the like. The bus bar 132 may be bent in a vertical direction according to the arrangement of obstacles. The bus bar 131 drawn from the first electrode 17 may have a U-shape as shown in FIG. 12C. By virtue of such a shape, a difference in length of the bus bar on the side of the switching part 130 can be absorbed by elastic deformation. For example, in a case where the bus bar on the side of the switching part 130 is long, the length can be absorbed by inward bending of an end part of the bus bar 131 as shown by the chain double-dashed line in FIG. 12C. The bus bar 131 drawn from the first electrode 17 is opposed to the positive electrode 126A of the power transformer 127, and the bus bar 132 drawn from the second electrode 18 is opposed to the negative electrode 126B of the power transformer 127.

As shown in FIG. 12A, in the switching part 130, the bus bar 131 drawn from the first electrode 17 and the positive electrode 126A of the power transformer 127 are connected by a straight bus bar 133A, and the bus bar 132 drawn from the second electrode 18 and the negative electrode 126B of the power transformer 127 are connected by a straight bus bar 133B. Accordingly, the first electrode 17 is connected to the positive electrode 126A, and the second electrode 18 is connected to the negative electrode 126B. In a case where the current flow is switched from the above state, as shown in FIG. 12B, in the switching part 130, the bus bar 131 drawn from the first electrode 17 and the negative electrode 126B of the power transformer 127 are connected by a bus bar 134B extending in an oblique direction, and the bus bar 132 drawn from the second electrode 18 and the positive electrode 126A of the power transformer 127 are connected by a bus bar 134A extending in an oblique direction. The switching of the switching part 130 is performed by changing the bus bars by a manual operation of an operator.

As described above, in the forming device 10 according to the second embodiment, the die movement suppressing part 110 may be provided with the die magnetization suppressing part 120 that suppresses the movement of the die 13 by an electromagnetic force by suppressing the magnetization of the die 13. In this manner, by suppressing the magnetization of the die 13 by the die magnetization suppressing part 120, the electromagnetic force acting on the die 13 can be reduced when the energization to the metal pipe material 14 is performed by the electrodes 17 and 18. Accordingly, the movement of the die 13 by an electromagnetic force can be suppressed.

In the forming device 10 according to the second embodiment, the die magnetization suppressing part 120 is provided with the switching parts 125 and 130 that switch the direction of a DC current that is supplied to the electrodes 17 and 18. The magnetization of the die 13 can be cancelled by allowing a DC current in an opposite direction to flow to the electrodes 17 and 18. For example, in a case where the heating by energization is continued for a certain period of time in a state in which the first electrode 17 acts as a positive electrode and the second electrode 18 acts as a negative electrode, the die 13 is magnetized in a predetermined direction. However, in a case where the heating by energization is performed with a DC current flow reversed with the first electrode 17 acting as a negative electrode and the second electrode 18 acting as a positive electrode, the magnetization in the predetermined direction in the die 13 can be cancelled.

Third Embodiment

Figure 13:
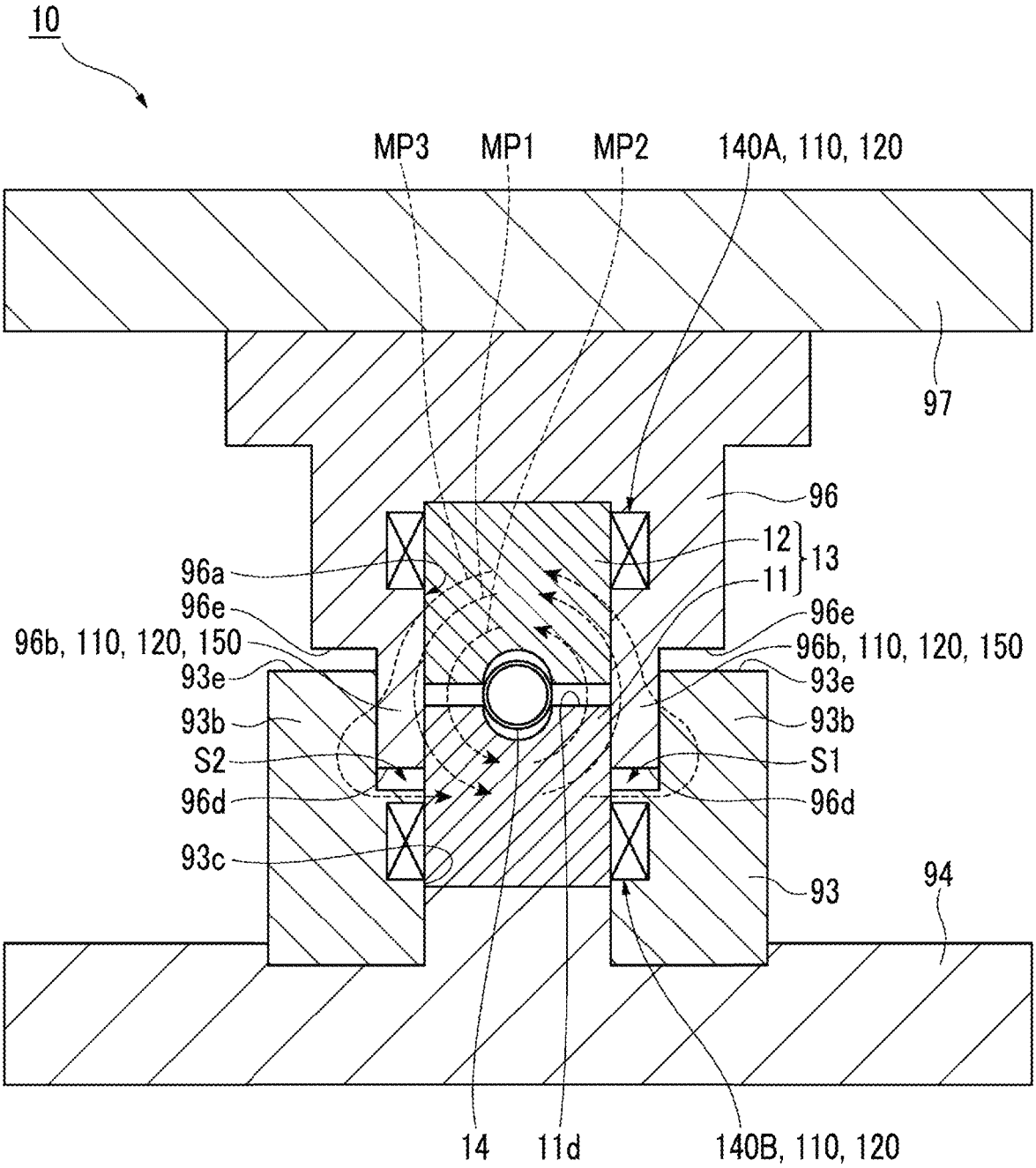
FIG. 13 is a schematic cross-sectional view of a forming device according to a third embodiment.

In a forming device 10 according to a third embodiment of the invention, a die movement suppressing part 110 is provided with a die magnetization suppressing part 120 that suppresses the movement of a die 13 by an electromagnetic force by suppressing the magnetization of the die 13. In addition, as shown in FIG. 13, in the forming device 10 according to the third embodiment, the die magnetization suppressing part 120 is provided with coils 140A and 140B surrounding the die 13. The coils 140A and 140B are provided to surround an upper die 12 and a lower die 11, respectively. The die magnetization suppressing part 120 is further provided with a magnetic flux loop forming part 150 including a protrusion 96*b* extending from an upper die holder 96 toward a lower die holder 93 at a position adjacent to the die 13.

The coils 140A and 140B are provided to surround side surfaces of the upper die 12 and the lower die 11, respectively, and in this embodiment, the coils are disposed to be buried in the die holders 93 and 96, respectively. The coil 140A is disposed on the upper end side of the upper die 12, and the coil 140B is disposed on the lower end side of the lower die 11 so as not to be a disturbance during the forming. The coils 140A and 140B are provided in contact with the side surfaces of the upper die 12 and the lower die 11, respectively. Accordingly, magnetic fluxes of the coils 140A and 140B easily act on the upper die 12 and the lower die 11. However, the coils may be provided to be separated from the side surfaces of the upper die 12 and the lower die 11, respectively. The coils 140A and 140B may be provided on the outer peripheral sides of the die holders 93 and 96, respectively. An AC current or the like may be applied to the coils 140A and 140B while the amplitude is gradually reduced. Otherwise, not an AC current, a DC current may be applied to the coils 140A and 140B by positive/negative inversion. The operation timing of the coils 140A and 140B is not particularly limited. The operation may be performed during the heating by energization is performed, for every heating by energization, or for every plural heating operations by energization.

In a state in which the heating by energization is performed as shown in FIG. 13, the protrusion 96*b* constituting the magnetic flux loop forming part 150 protrudes downward from a step surface 96*e* and extends downward along the side surface of the upper die 12. In addition, the protrusion 96*b* extends downward more than an upper end surface 93*e* of a protrusion 93*b* of the first lower die holder 93, and extends downward more than an upper surface 11*d* of the lower die 11. That is, the protrusion 96*b* extends downward along the side surface of the lower die 11. In this manner, the protrusion 96*b* is provided at a position adjacent to the upper die 12 and the lower die 11. In addition, the protrusion 96*b* is adjacent to the protrusion 93*b* of the first lower die holder 93 on a side opposite to the die 13.

As described above, in the forming device 10 according to the third embodiment, the die magnetization suppressing part 120 is provided with the coils 140A and 140B surrounding the die 13. Accordingly, the magnetization remaining in the die 13 can be cancelled with magnetic fluxes generated by the coils 140A and 140B.

In the forming device 10 according to the third embodiment, the coils 140A and 140B are provided to surround the upper die 12 and the lower die 11, respectively. The magnetization of the die 13 can be efficiently cancelled by providing the coils 140A and 140B in both of the upper die 12 and the lower die 11. However, there is no need to provide both of the coil 140A associated with the upper die 12 and the coil 140B associated with the lower die 11, and any one of them may be provided. A plurality of coils may be provided with respect to each of the upper die 12 and the lower die 11.

In the forming device 10 according to the third embodiment, the die magnetization suppressing part 120 is provided with the magnetic flux loop forming part 150 including the protrusion 96*b* extending from the first upper die holder 96 toward the first lower die holder 93 at a position adjacent to the die 13. Accordingly, the concentration of a magnetic flux loop MP in the lower die 11 and the upper die 12 can be suppressed, and thus promotion of the magnetization of the die 13 can be suppressed.

For example, in a case where the protrusion 96*b* constituting the magnetic flux loop forming part 150 is not provided, the magnetic flux is directly directed from the upper die 12 to the lower die 11 and from the lower die 11 to the upper die 12 in a dominant manner as in a case of a magnetic flux loop MP2, and thus the magnetization of the die 13 easily proceeds due to the concentration of the magnetic flux in the die 13. In a case where the magnetic flux loop forming part 150 is formed, the magnetic flux is formed to be directed from the upper die 12 to the lower die 11 via the protrusion 96*b* and from the lower die 11 to the upper die 12 via the protrusion 96*b* as in a case of a magnetic flux loop MP1. In addition, the magnetic flux is formed to be directed from the upper die 12 to the lower die 11 via the protrusions 96*b* and 93*b* and from the lower die 11 to the upper die 12 via the protrusion 96*b* and 93*b* as in a case of a magnetic flux loop MP3. Accordingly, promotion of the magnetization of the die 13 can be suppressed as compared to a case where the magnetic flux is concentrated in the die 13.

Figure 15:
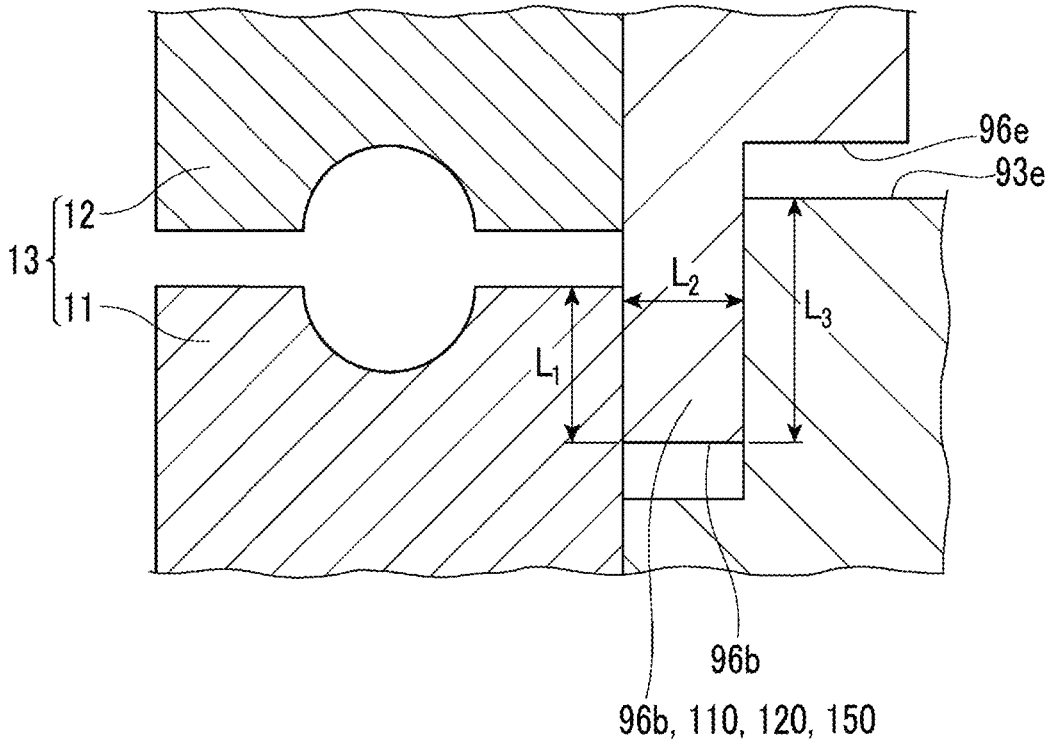
FIG. 15 is an enlarged view of the vicinity of an upper die and a lower die.

The magnetic flux loop forming part 150 may include a protrusion extending from the lower die 11 toward the upper die 12 along a side surface of the die 13. In the embodiment shown in FIG. 13, the protrusion 96*b* is adjacent to the first lower die holder 93 since it reaches the upper end surface 93*e*. The protrusion is also adjacent to the lower die 11 since it reaches the upper surface 11*d*. However, in the positional relationship shown in FIG. 15, in a case where the protrusion 96*b* reaches such a position that L1 is equal to or greater than L2, a magnetic flux loop can be effectively formed such that promotion of the magnetization of the die 13 can be suppressed. A preferable effect is also obtained in a case where the protrusion 96*b* reaches such a position that L3 is equal to or greater than L2. The relationship between L3 and L2 contributes to the magnetic flux loop MP3 of FIG. 13. A more satisfactory effect is obtained in a case where L1 is equal to or greater than L2 than in a case where L3 is equal to or greater than L2. Both L1 and L3 may be equal to or greater than L2.

Fourth Embodiment

Figure 14:
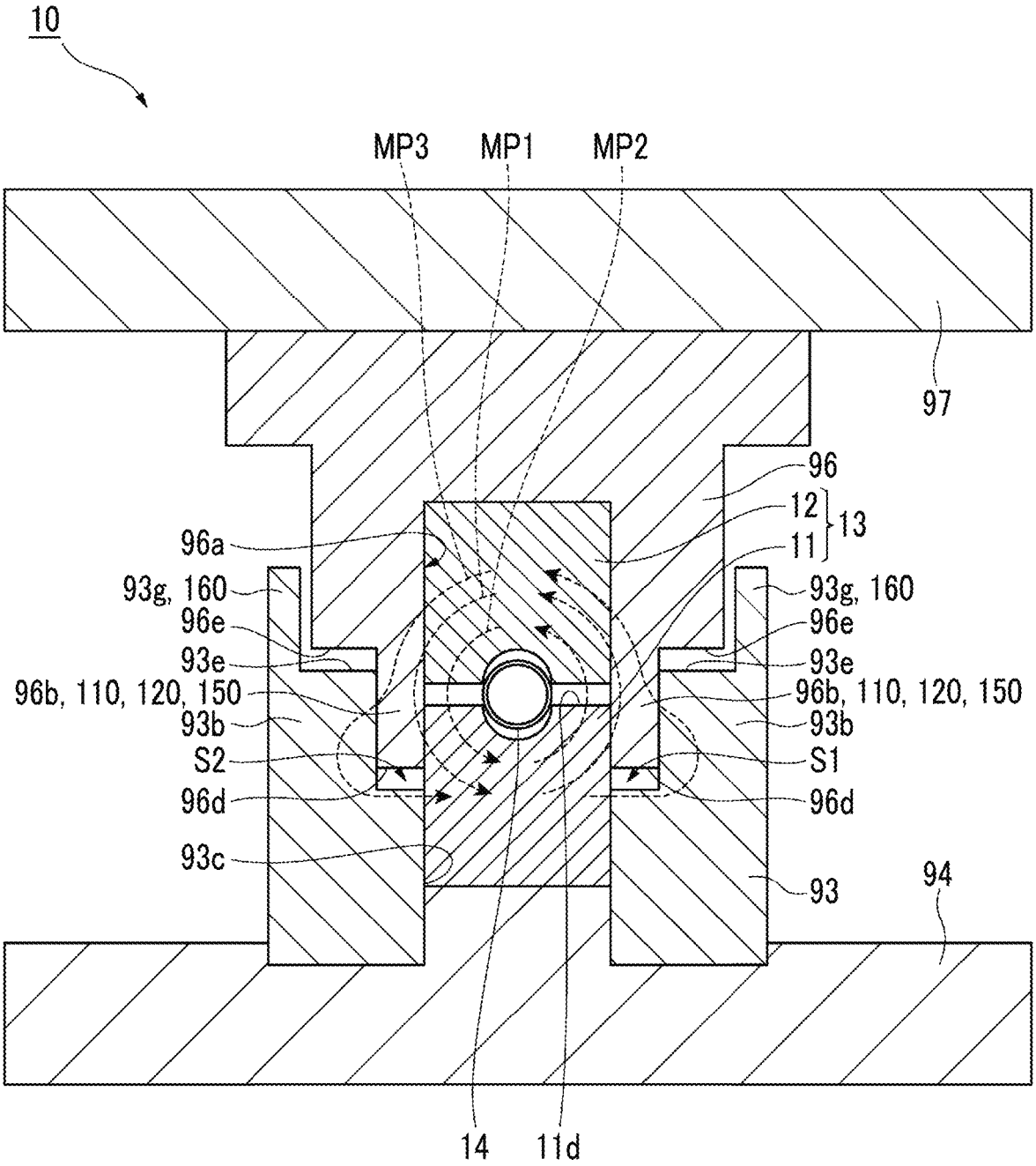
FIG. 14 is a schematic cross-sectional view of a forming device according to a fourth embodiment.

In a forming device 10 according to a fourth embodiment of the invention, a die movement suppressing part 110 is provided with a die magnetization suppressing part 120 that suppresses the movement of a die 13 by an electromagnetic force by suppressing the magnetization of the die 13. In addition, as shown in FIG. 14, the die magnetization suppressing part 120 is provided with a magnetic flux loop forming part 150 including a protrusion 96*b* extending from an upper die holder 96 toward a lower die holder 93 at a position adjacent to the die 13. In addition, in the forming device 10 according to the fourth embodiment, a protrusion 93*g* provided on the outer surface side of the first lower die holder 93 forms a leakage magnetic field suppressing part 160.

The protrusion 93*g* constituting the leakage magnetic field suppressing part 160 extends upward from an edge part on the outer surface side of an upper end surface 93*e* of the first lower die holder 93. The protrusion 93*g* extends upward more than a step surface 96*e* of the first upper die holder 96. Accordingly, a gap between the step surface 96*e* and the upper end surface 93*e* is blocked by the protrusion 93*g* constituting the leakage magnetic field suppressing part 160.

As described above, in the forming device 10 according to the fourth embodiment, the die magnetization suppressing part 120 is provided with the magnetic flux loop forming part 150 including the protrusion 96*b* extending from the first upper die holder 96 toward the first lower die holder 93 at a position adjacent to the die 13. Accordingly, the concentration of a magnetic flux loop MP in the lower die 11 and the upper die 12 can be suppressed, and thus promotion of the magnetization of the die 13 can be suppressed.

In the forming device 10 according to the fourth embodiment, the protrusion 93*g* provided on the outer surface side of the first lower die holder 93 forms the leakage magnetic field suppressing part 160. Accordingly, it is possible to prevent a leakage magnetic field from affecting an external device with a simple configuration in which the first lower die holder 93 is provided with the protrusion 93*g*. The protrusion constituting the leakage magnetic field suppressing part 160 may be provided on the outer surface side of the first upper die holder 96. Otherwise, a plurality of protrusions provided alternately in the first upper die holder 96 and the first lower die holder 93 may constitute the leakage magnetic field suppressing part 160.

The invention is not limited to the above-described embodiments. In a forming device according to an aspect of the invention, the above-described elements can be arbitrarily changed within such a range as not to change the concepts of the claims.

The blow forming die 13 may be either a non-water cooling die or a water cooling die. However, a non-water cooling die requires a long period of time in a case where the die is cooled to near room temperature after the completion of the blow forming. Regarding this, in a case of a water cooling die, the cooling is completed in a short period of time. Accordingly, a water cooling die is desirable from the viewpoint of an improvement in productivity.

In the above-described embodiments, the upper die holding part 92 and the lower die holding part 91 are provided to hold the blow forming die 13. However, the holding parts 91 and 92 may be omitted in an embodiment in which the configurations itself of the holding parts 91 and 92 do not function as a die movement suppressing part.

According to an aspect of the invention, at least one of the above-described die movement suppressing parts 110 may be provided. That is, the forming device 10 may have at least one of the fixing part 111, the switching parts 125 and 130, the coils 140A and 140B, and the magnetic flux loop forming part 150. Otherwise, the forming device 10 may have a configuration related to a combination of two or more of the fixing part 111, the switching parts 125 and 130, the coils 140A and 140B, and the magnetic flux loop forming part 150, or may have all of them.

It should be understood that the invention is not limited to the above-described embodiment, but may be modified into various forms on the basis of the spirit of the invention. Additionally, the modifications are included in the scope of the invention.

What is claimed is:

1. A forming device that expands a metal pipe material to form a metal pipe, the device comprising:

a die that has an upper die and a lower die, either the upper die or the lower die is movable to form the metal pipe;

an electrode configured to supply, to the metal pipe material, energization that heats the metal pipe material at a location of the die where an electromagnetic force caused by the energization acts on the die to move the die;

a gas supply part configured to supply, into the metal pipe material when the electrode supplies the energization to the metal pipe material, a gas that expands the metal pipe material; and a die movement suppressing part configured to suppress, when the electrode supplies the energization to the metal pipe material, movement of the die that is caused by the electromagnetic force, wherein the die movement suppressing part is provided with a die magnetization suppressing part that suppresses the movement of the die by an electromagnetic force by suppressing the magnetization of the die.

2. The forming device according to claim 1, wherein the upper die is supported by an upper die holder and the lower die is supported by a lower die holder, the die movement suppressing part is provided with a fixing part that mechanically fixes the lower die at least when the electrode supplies the energization, the fixing part is attached to a side surface on an outer side of the lower die holder.

3. The forming device according to claim 2, wherein the fixing part is provided with a pin that is inserted into a side surface of the lower die at least when the energization to the metal pipe material is performed by the electrode.

4. The forming device according to claim 1, wherein the electrode is between the die and the gas supply part.

5. The forming device according to claim 1, wherein the electromagnetic force is generated when the electrode supplies the energization to the metal pipe material.

6. The forming device according to claim 1, wherein the die is magnetizable by the electromagnetic force.

7. The forming device according to claim 1, wherein the upper die and the lower die are movable.

8. A forming device that expands a metal pipe material to form a metal pipe, the device comprising:

a die that has an upper die and a lower die, either the upper die or the lower die is movable to form the metal pipe;

an electrode configured to supply, to the metal pipe material, energization that heats the metal pipe material;

a gas supply part configured to supply, into the metal pipe material when the electrode supplies the energization to the metal pipe material, a gas that expands the metal pipe material; and a die movement suppressing part configured to suppress, when the electrode supplies the energization to the metal pipe material, movement of the die that is caused by an electromagnetic force, wherein the die movement suppressing part is provided with a die magnetization suppressing part that suppresses the movement of the die by an electromagnetic force by suppressing the magnetization of the die.

9. The forming device according to claim 8, wherein the die magnetization suppressing part is provided with a switching part that switches the direction of a DC current that is supplied to the electrode.

10. The forming device according to claim 8, wherein the die magnetization suppressing part is provided with a coil surrounding the die.

11. The forming device according to claim 10, wherein the coil is provided to surround each of the upper die and the lower die.

12. The forming device according to claim 8, wherein the upper die is supported by an upper die holder and the lower die is supported by a lower die holder, and the die magnetization suppressing part is provided with a magnetic flux loop forming part including a protrusion extending from one of the upper die holder and the lower die holder toward the other at a position adjacent to the die.

13. The forming device according to claim 12, wherein the protrusion provided on the outer surface side of at least one of the upper die holder and the lower die holder forms a leakage magnetic field suppressing part.

14. The forming device according to claim 8, wherein the upper die and the lower die are movable.

15. A forming device that expands a metal pipe material to form a metal pipe, the device comprising:

a die that has an upper die and a lower die, the upper die and the lower die are movable to form the metal pipe;

an electrode configured to supply, to the metal pipe material, energization that heats the metal pipe material;

a gas supply part configured to supply, into the metal pipe material when the electrode supplies the energization to the metal pipe material, a gas that expands the metal pipe material; and a die movement suppressing part configured to suppress, when the electrode supplies the energization to the metal pipe material, movement of the die that is caused by an electromagnetic force.

* * * * *